US006584628B1

(12) United States Patent
Kummer et al.

(10) Patent No.: US 6,584,628 B1
(45) Date of Patent: Jul. 1, 2003

(54) HOSPITAL BED HAVING A ROTATIONAL THERAPY DEVICE

(75) Inventors: Joseph A. Kummer, Cincinnati, OH (US); Gregory W. Branson, Batesville, IN (US); Eric R. Meyer, Greensburg, IN (US); Brad Wilson, Batesville, IN (US); Tanya Taber, Lawrenceburg, IN (US); Ken Chambers, Batesville, IN (US); Mike Frondorf, Lakeside Park, KY (US); John Vodzak, Batesville, IN (US); Jim Stolpmann, Charleston, SC (US); Roger Dalton, Moncks Corner, SC (US); Ken Smith, Charleston, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/532,592

(22) Filed: Mar. 22, 2000

Related U.S. Application Data

(63) Continuation-in-part of application No. 09/018,542, filed on Feb. 4, 1998, now Pat. No. 6,163,903, which is a continuation of application No. 08/511,711, filed on Aug. 4, 1995, now Pat. No. 5,715,548.

(51) Int. Cl.[7] ..... A61G 7/057
(52) U.S. Cl. ..... 5/615; 5/710; 5/713; 5/715
(58) Field of Search ..... 5/424, 425, 427, 5/428, 430, 615, 710, 713, 715

(56) References Cited

U.S. PATENT DOCUMENTS 1,772,310 A 8/1930 Hart
3,492,988 A 2/1970 De Mare (List continued on next page.)

FOREIGN PATENT DOCUMENTS

WO WO 94/27544 12/1994
WO WO 99/09865 3/1999

OTHER PUBLICATIONS

"The Pillo–Pump® Alternating Pressure System," Gaymar Industries, Inc., advertising brochures, 2 pages, date 1986.
"Grant Dyna–Care," Grant advertising literature, one page, date unknown.
"ALAMO–Alternating Low Airloss Mattress Overlay," National Patient Care Systems, Inc., advertising literature, one page, date unknown.
"Sof–Care Plus® Long Term Bed Cushion", Gaymar Industries, Inc., advertising literature, 1985.
"AIRFLO by Gaymar, Alternating Pressure Relief System," Gaymar Industries, Inc.,advertising literature, date unknown.
"AIRFLOW PLUS," Gaymar Industries, Inc. advertising literature, 1988.
"Using Sof–Care® just got easier . . . ," Gaymar Industries, Inc,. advertising literature, one page, 1992.
"The System That Continues To Set The Standard . . . To Supply You with Proven Benefits", Gaymar Industries, Inc, advertising literature, Pillo Pad ™, date unknown.
"A Pressure Relief Device Based On Fact, Not Fiction . . . Take a Closer Look . . . ", Gaymar Industries, Inc. advertising literature, Sof–Care®, 11/88.

*Primary Examiner*—Michael F. Trettel
(74) *Attorney, Agent, or Firm*—Bose McKinney & Evans LLP

(57) ABSTRACT

A chair bed including a bedframe and a mattress positioned on the bedframe is provided. The bedframe is configured to move between a substantially flat bed position and a chair position. The mattress includes an inflatable treatment apparatus such as a pulmonary rotational therapy device, a pulsation therapy device, or a decubitus ulcer treatment device.

87 Claims, 22 Drawing Sheets

U.S. PATENT DOCUMENTS 3,674,019 A 7/1972 Grant
3,867,732 A 2/1975 Morrell
4,193,149 A 3/1980 Welch
4,224,706 A 9/1980 Young et al.
4,394,784 A 7/1983 Swenson et al.
4,411,035 A 10/1983 Fenwick
4,435,864 A 3/1984 Callaway
4,525,409 A 6/1985 Elesh
4,628,557 A 12/1986 Murphy
4,638,519 A 1/1987 Hess
4,803,744 A 2/1989 Peck et al.
4,862,529 A 9/1989 Peck
4,897,890 A 2/1990 Walker
4,951,335 A 8/1990 Eady
4,977,633 A 12/1990 Chaffee
4,982,466 A 1/1991 Higgins et al.
4,986,738 A 1/1991 Kawasaki et al.
4,991,244 A 2/1991 Walker
4,993,920 A 2/1991 Harkleroad et al.
4,999,867 A 3/1991 Toivio et al.
5,007,123 A 4/1991 Salyards
5,018,786 A 5/1991 Goldstein et al.
5,023,967 A 6/1991 Ferrand
5,044,364 A 9/1991 Crowther
5,052,068 A 10/1991 Graebe
5,060,174 A 10/1991 Gross
5,062,169 A 11/1991 Kennedy et al.
5,068,933 A 12/1991 Sexton
5,083,335 A 1/1992 Krouskop et al.
5,095,568 A 3/1992 Thomas et al.
5,103,519 A 4/1992 Hasty
5,129,117 A 7/1992 Celestina et al.
5,142,719 A 9/1992 Vrzalik
5,152,021 A 10/1992 Vrzalik
5,157,800 A 10/1992 Borders
5,170,364 A 12/1992 Gross et al.
5,179,742 A 1/1993 Oberle
5,279,010 A 1/1994 Ferrand et al.
5,325,551 A 7/1994 Tappel et al.
5,331,698 A 7/1994 Newkirk et al.
5,367,728 A 11/1994 Chang
5,375,273 A 12/1994 Bodine, Jr. et al.
5,454,126 A 10/1995 Foster et al.
5,479,666 A 1/1996 Foster et al.
5,487,196 A 1/1996 Wilkinson et al.
5,586,346 A 12/1996 Stacy et al.
5,606,754 A 3/1997 Hand et al.
5,611,096 A 3/1997 Bartlett et al.
5,715,548 A 2/1998 Weismiller et al.
5,781,949 A * 7/1998 Weismiller et al. ..... 5/715
5,983,429 A 11/1999 Stacy et al.
6,021,533 A 2/2000 Ellis et al.
6,079,070 A * 6/2000 Flick ..... 5/713
6,085,372 A * 7/2000 James et al. ..... 5/713
6,145,142 A * 11/2000 Rechin et al. ..... 362/276

* cited by examiner

HOSPITAL BED HAVING A ROTATIONAL THERAPY DEVICE

This application is a continuation-in-part of application U.S. patent application Ser. No. 09/018,542, filed Feb. 4, 1998, now U.S. Pat. No. 6,163,903, the disclosure of which is expressly incorporated herein by reference, which is a continuation of U.S. patent application Ser. No. 511,711, filed Aug. 4, 1995, now U.S. Pat. No. 5,715,548, the disclosure of which is expressly incorporated herein by reference.

BACKGROUND AND SUMMARY OF THE INVENTION

The present invention relates to a bed, and particularly to patient-care beds. More particularly, the present invention relates to a chair bed that can be manipulated to achieve both a conventional bed position having a horizontal sleeping surface upon which a person lies in a supine position and a sitting position having the feet of the person on or adjacent to the floor and the head and back of the person supported above a seat formed by the bed.

It is known to provide hospital beds having a sleeping surface and siderails. The sleeping surface of such beds can often be manipulated to adjust the position of the person on the sleeping surface. It is also known to provide hospital beds which perform functions such as the prevention/treatment of decubitus ulcers (bedsores), pulmonary rotational therapy, or percussion/vibration therapy.

According to the present invention, a chair bed is provided including a bedframe and a mattress positioned on the bedframe. The bedframe includes a deck having a foot section that is movable between a substantially horizontal position when the bed is in a bed position and a substantially vertical position when the bed is in a chair position. The mattress includes a support surface and an inflatable treatment apparatus configured to move between inflated and deflated positions to provide treatment to a patient positioned on the support surface.

According to a presently preferred embodiment of the invention, the foot section is also movable between a retracted position having a first length and an extended position having a second length greater than the first length. The inflatable treatment apparatus includes a pulsation therapy device configured to pulsate at a predetermined rate and a rotational therapy device. The rotational therapy device is configured to maintain the right and left portions of the upper surface of the mattress at a normal height during normal operation of the mattress and to provide a rotational therapy operation. During the rotational therapy operation, the mattress is oscillated between first and second phases. During the first phase, the left portion of the upper surface is below the normal height and the right portion is above the normal height. During the second phase, the right portion of the upper surface is below the normal height and the left portion is above the normal height. The mattress further includes a layer of resilient material positioned between the pulsation therapy device and the rotational therapy device.

The bed further includes a rotational control module movable between an attached position coupled to the bedframe and a detached position spaced apart from the bedframe. The rotational control module controls the oscillations between the first and second phases of the rotational therapy operation. The bed further includes a peer-to-peer network, a master module electrically coupled to the peer-to-peer network, and a slave module, such as the rotational control module, electrically coupled to the master module. The master and slave modules are configured to perform a function related to operation of the bed. The bed further includes a removably coupled pulmonary pulsation control module from controlling percussion and/or vibration therapy of the patient.

Additional features of the disclosure will become apparent to those skilled in the art upon consideration of the following detailed description when taken in conjunction with the accompanying drawings.

BRIEF DESCRIPTION OF THE DRAWINGS

The detailed description particularly refers to the accompanying figures in which.

FIG.

Figure 1:
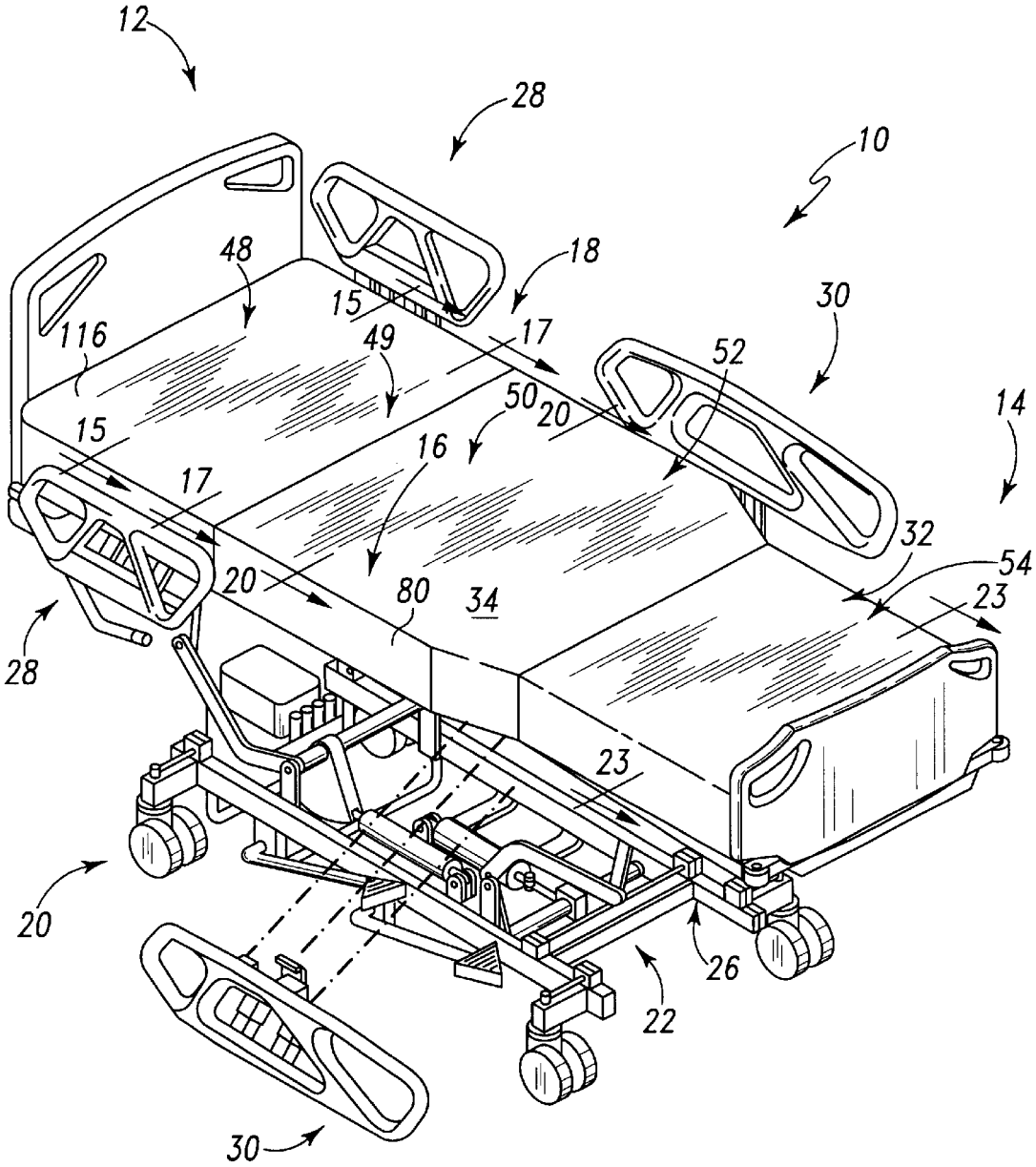
FIG. 1 is a perspective view of a chair bed in accordance with the present invention showing a foot end siderail exploded away from the chair bed and head end siderails and a foot end siderail positioned along longitudinal sides of the deck.
Figure 12:
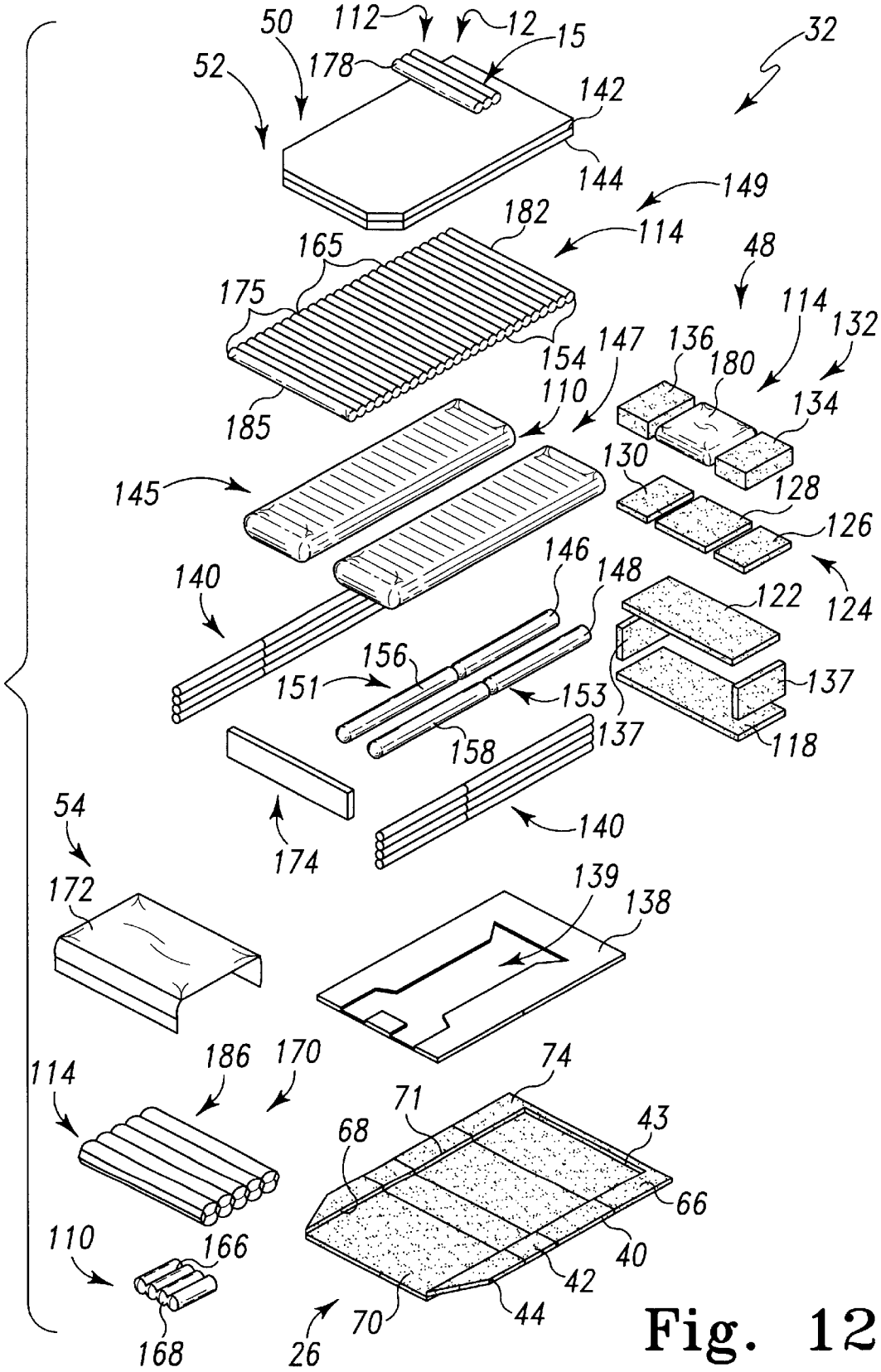
Figure 13:
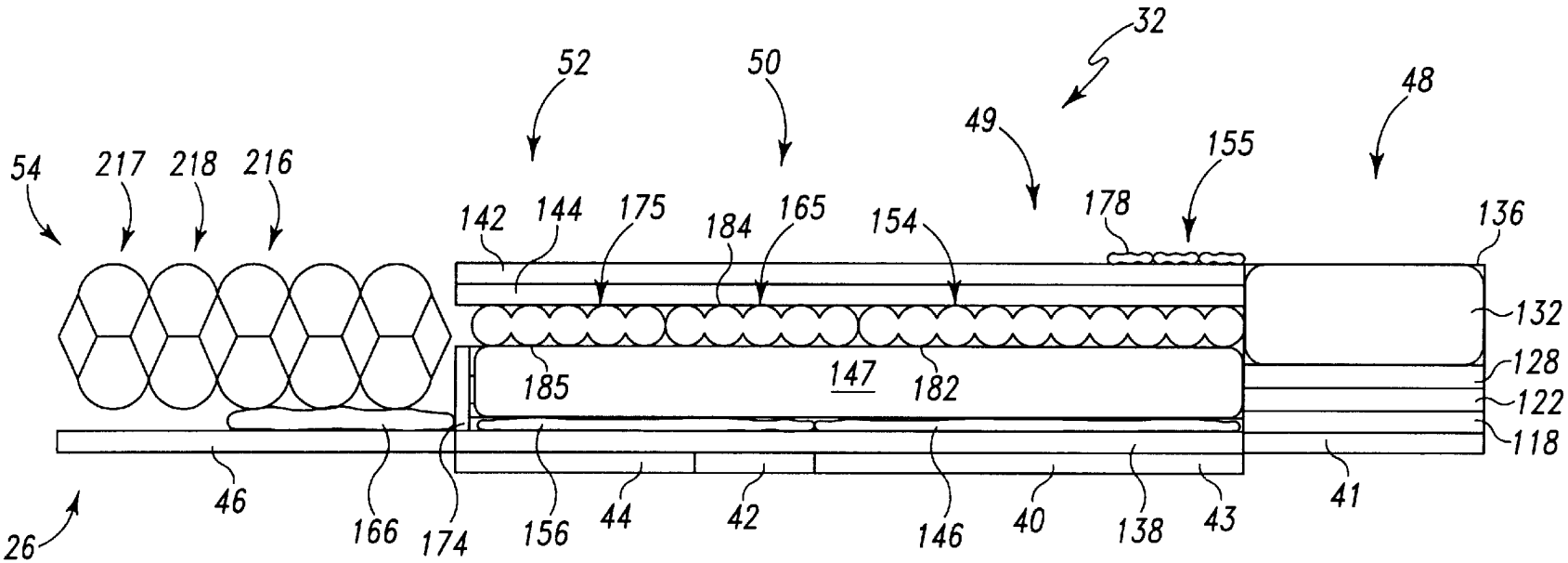
Figure 14:
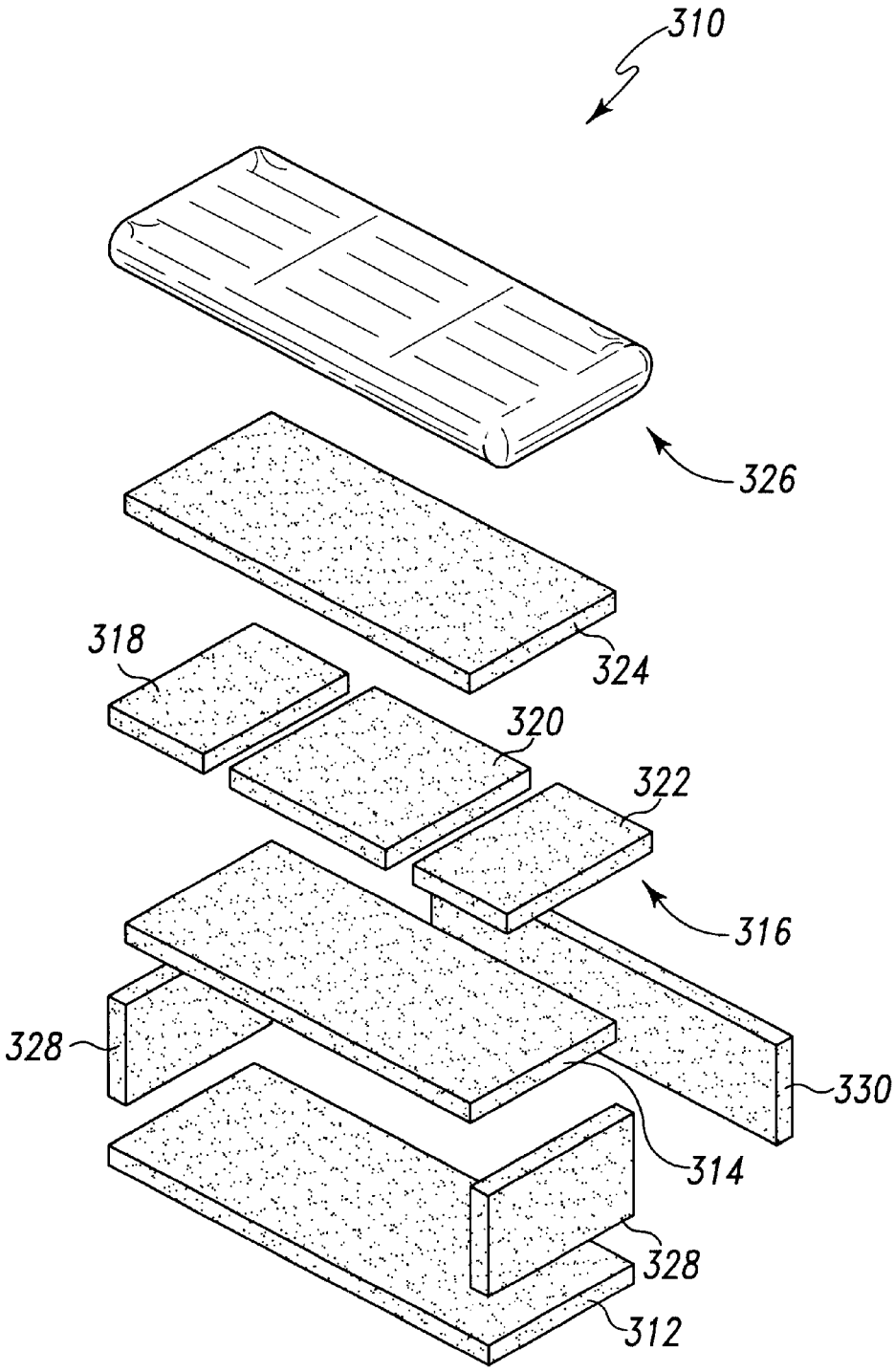
Figure 15:
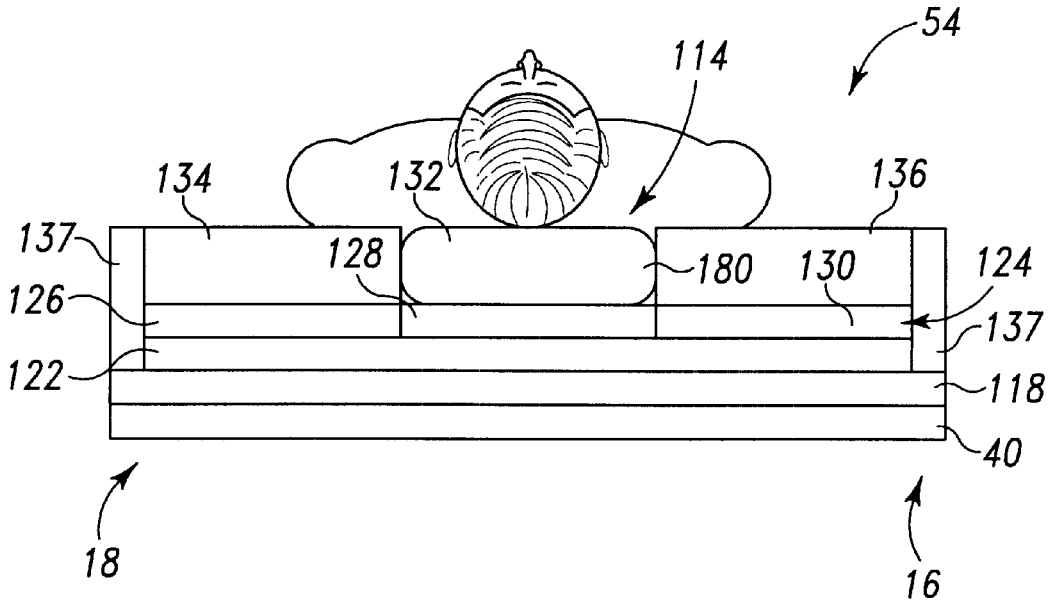
Figure 16:
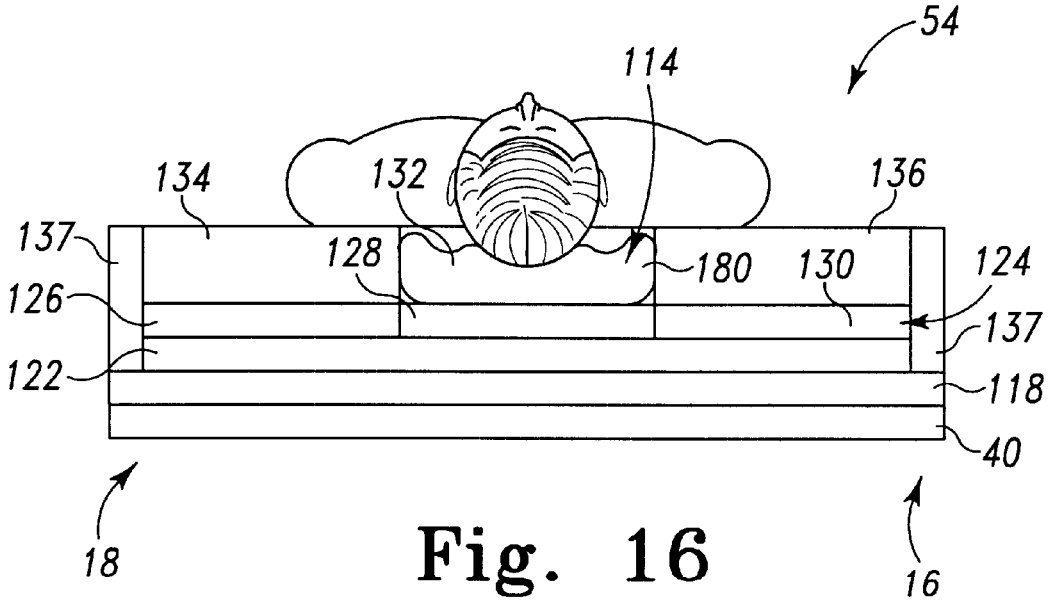
Figure 17:
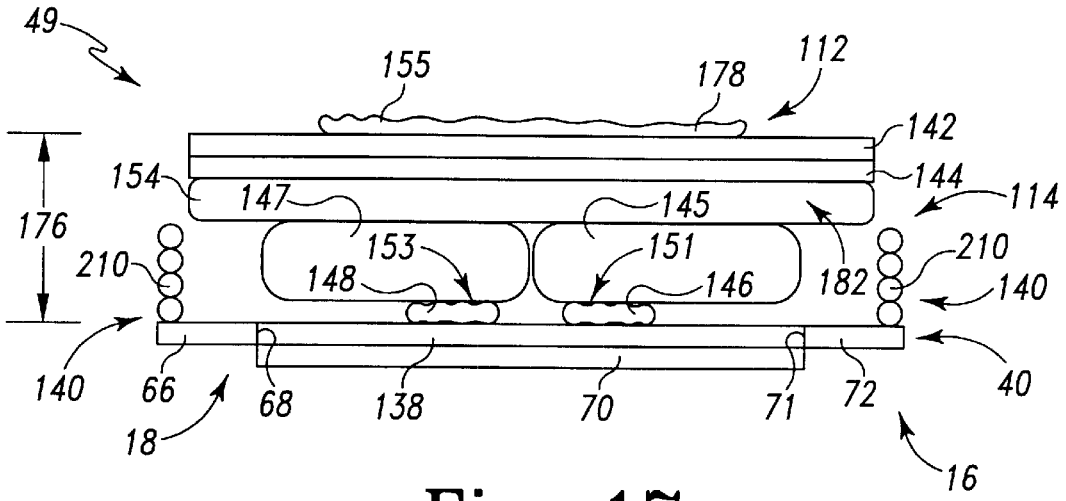
Figure 18:
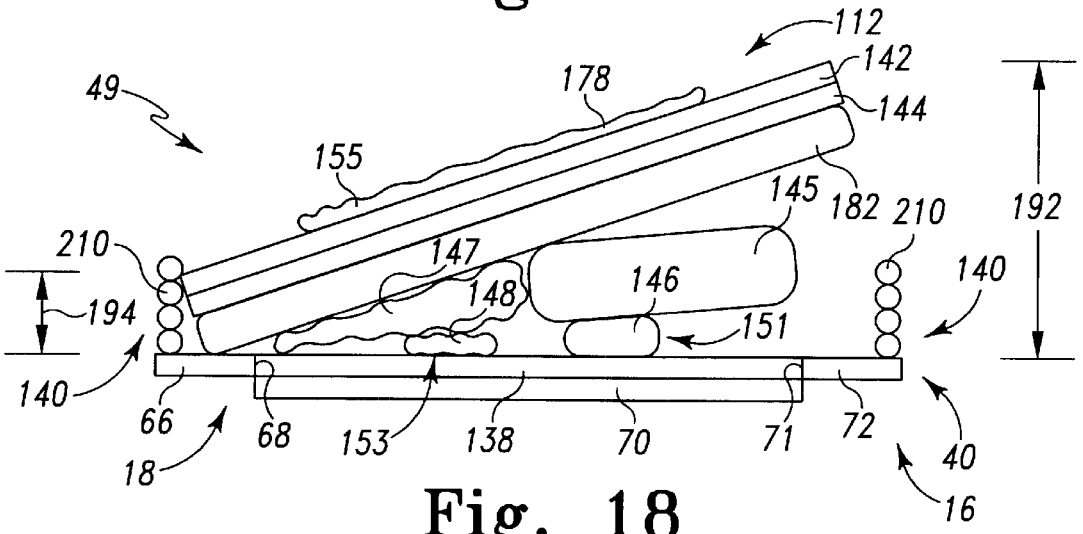
Figure 19:
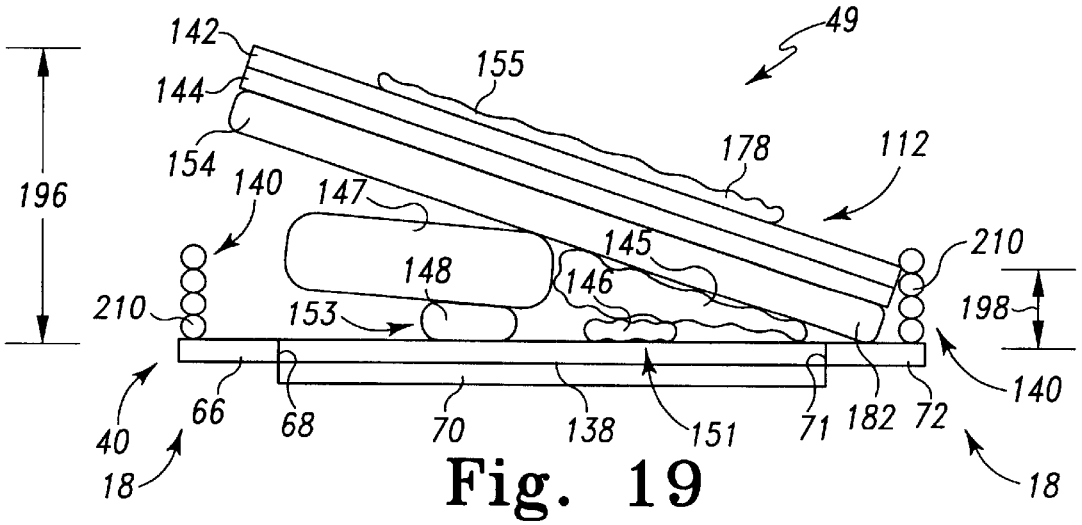
Figure 20:
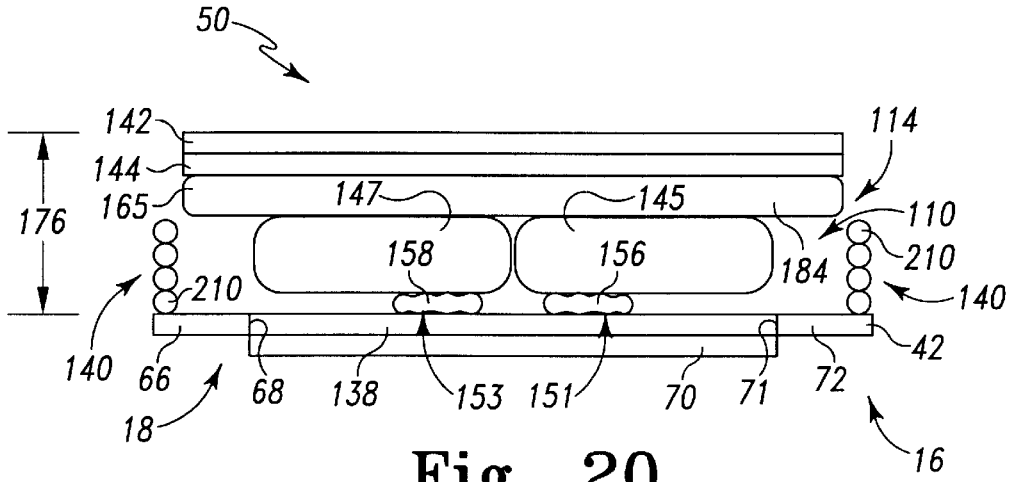
Figure 21:
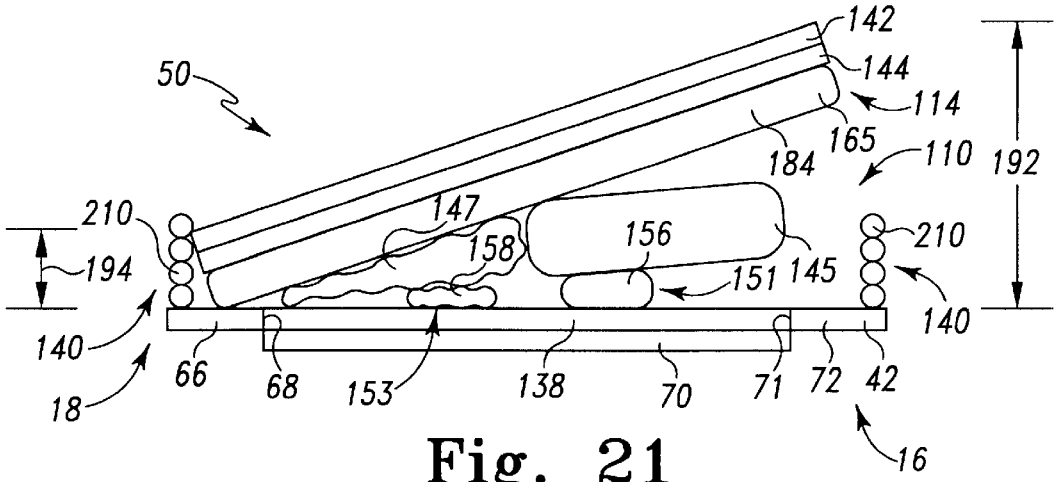
Figure 22:
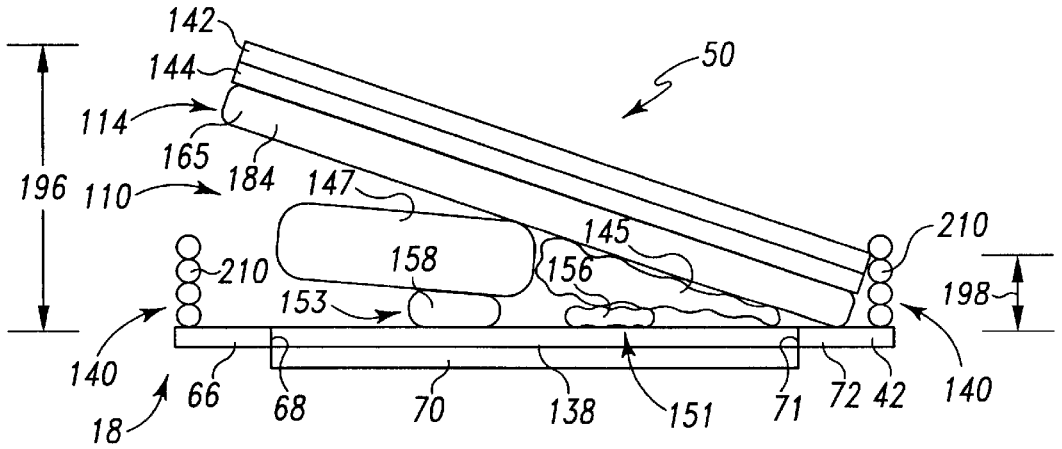
Figure 23:
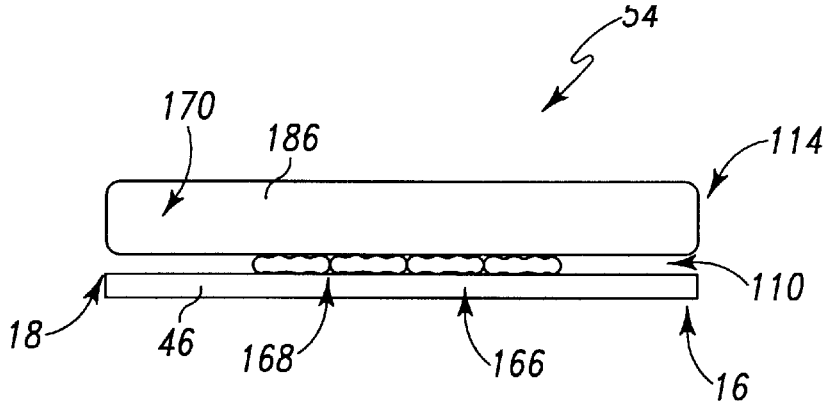
Figure 24:
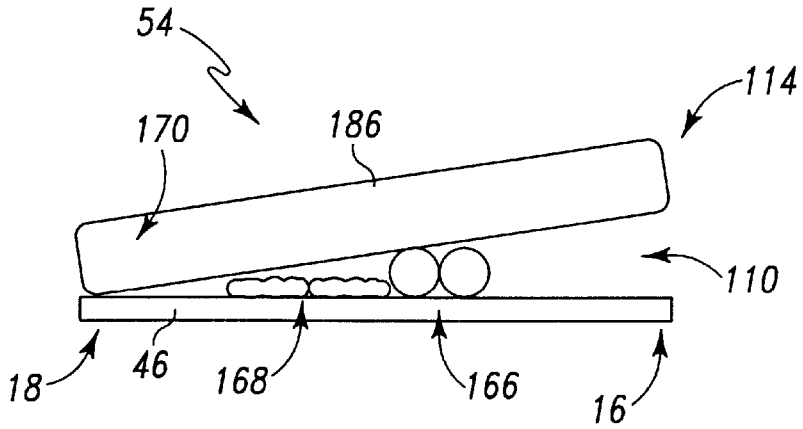
Figure 25:
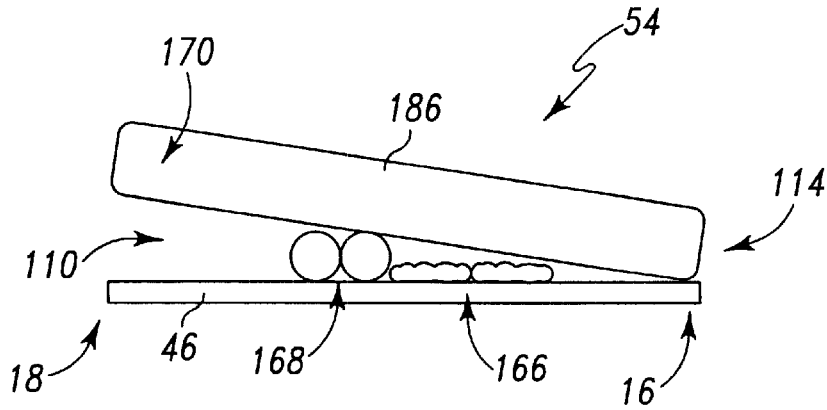
Figure 26:
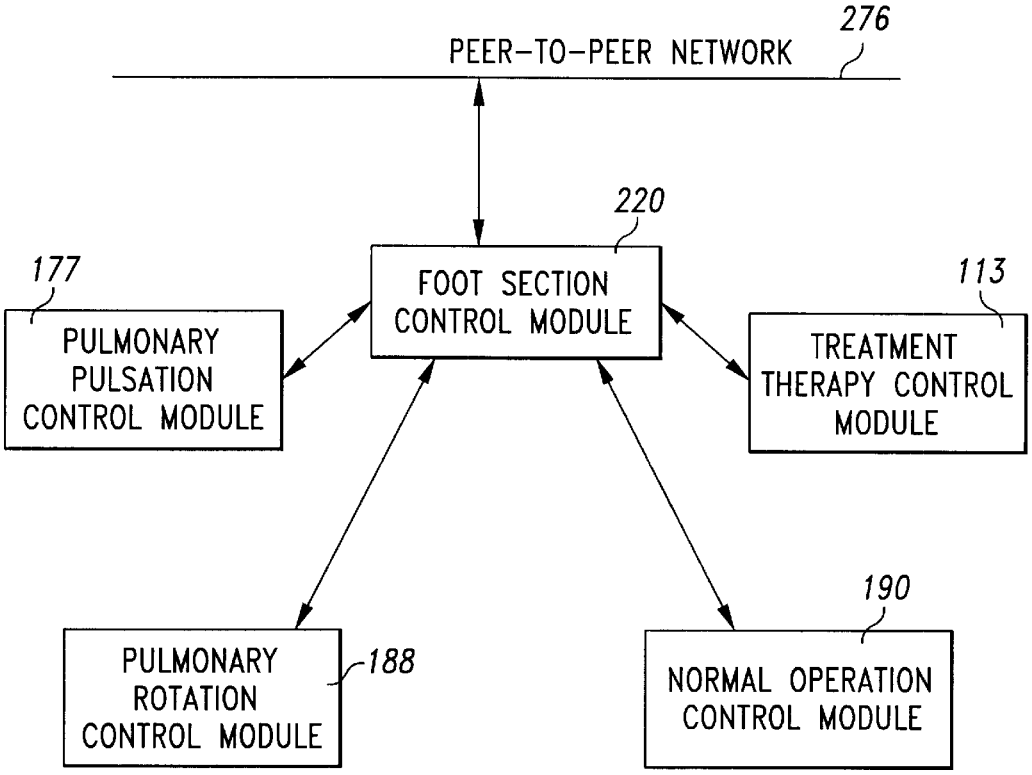
Figure 27:
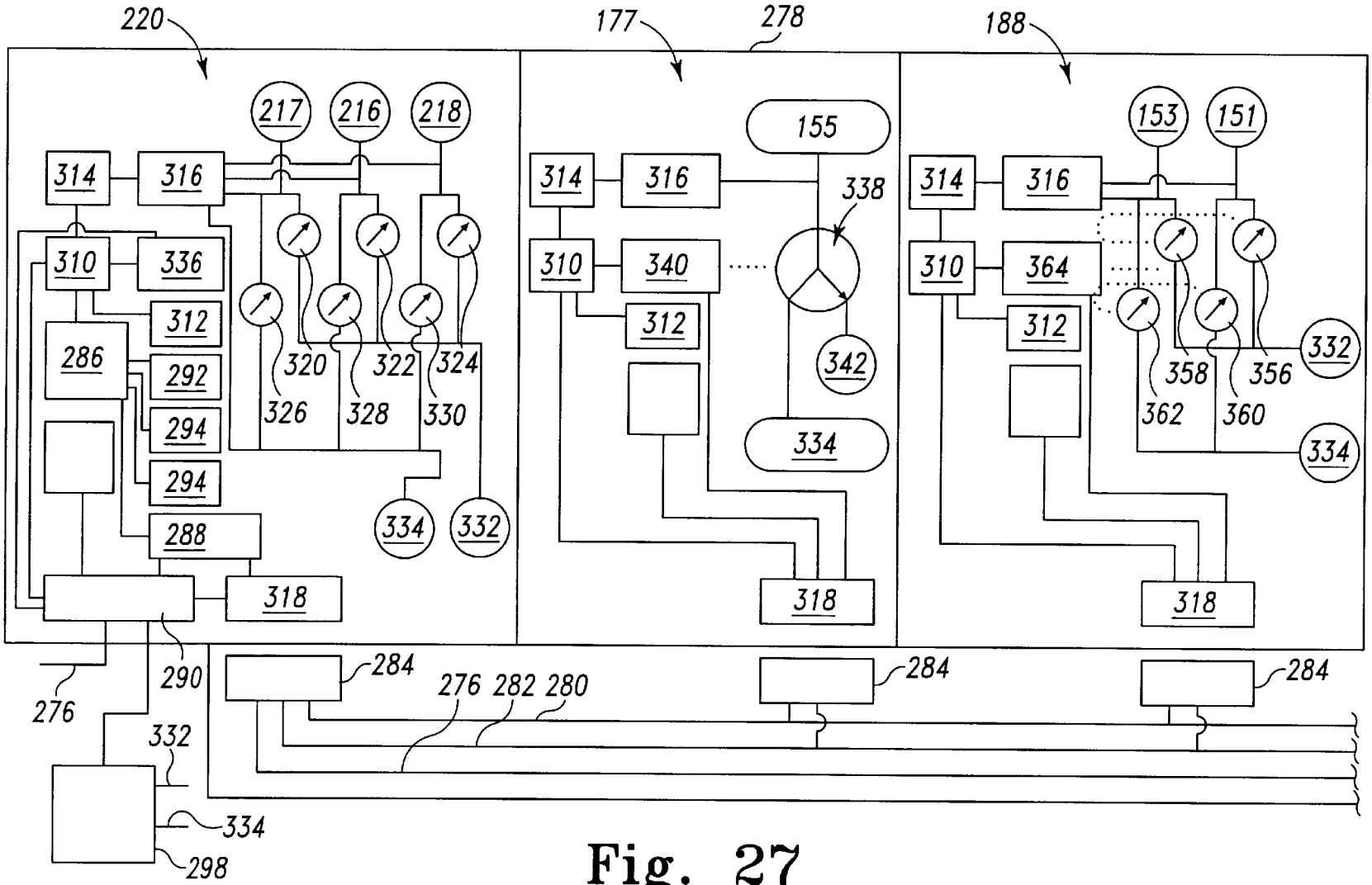
Figure 28:
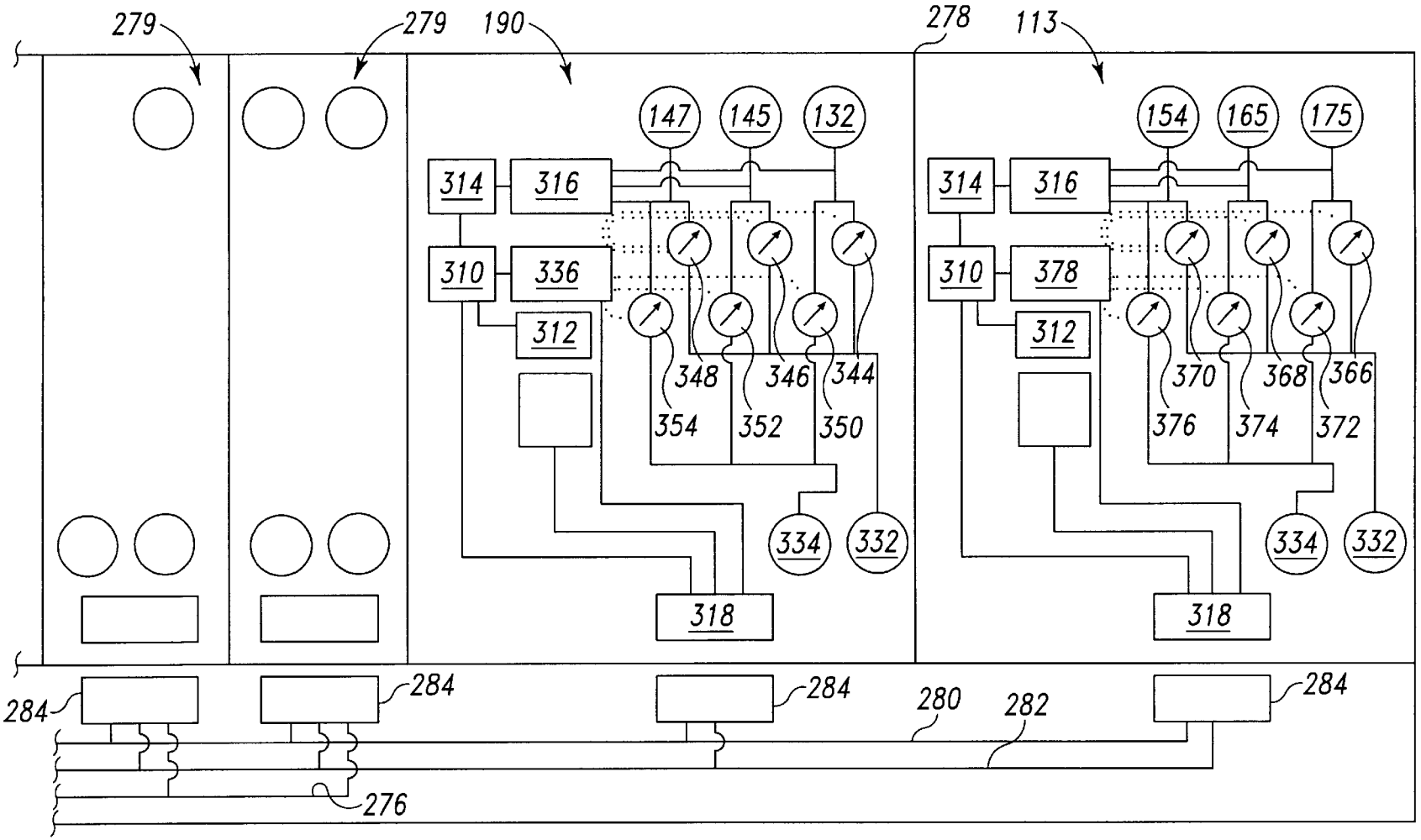
Figure 29:
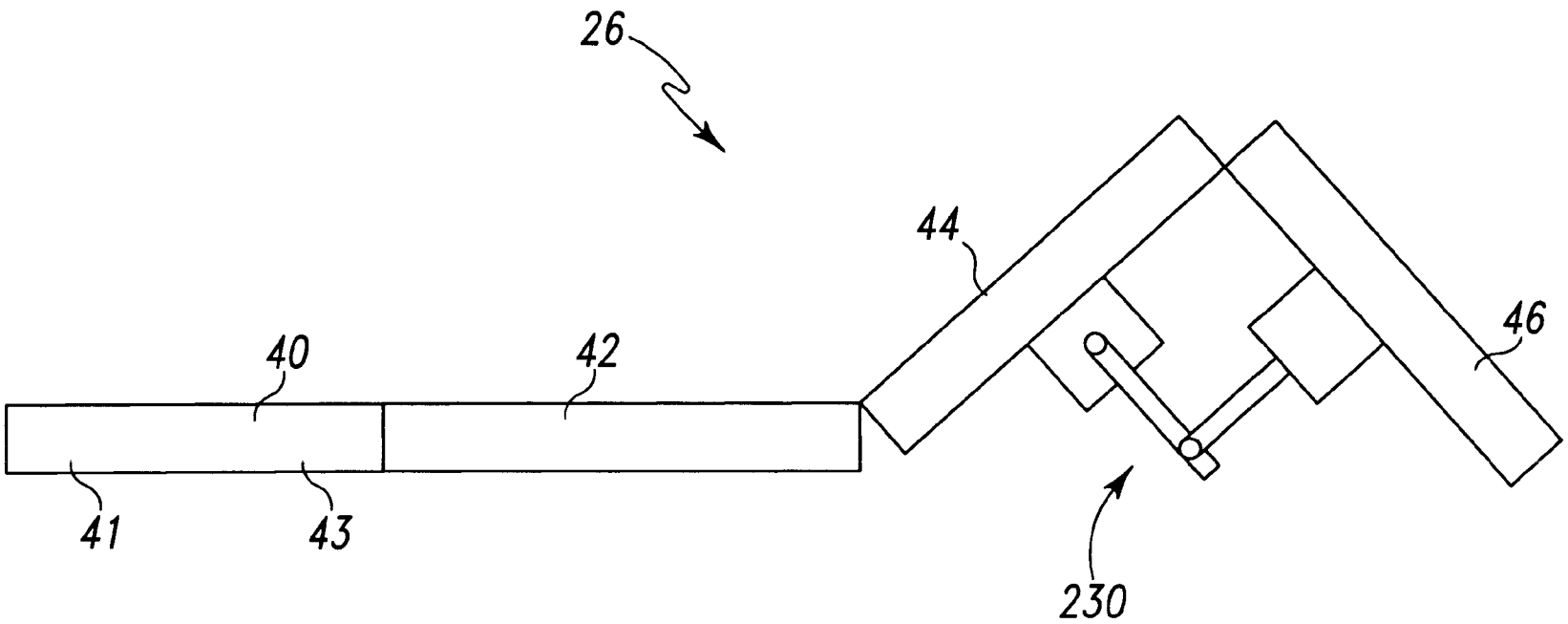
Figure 30:
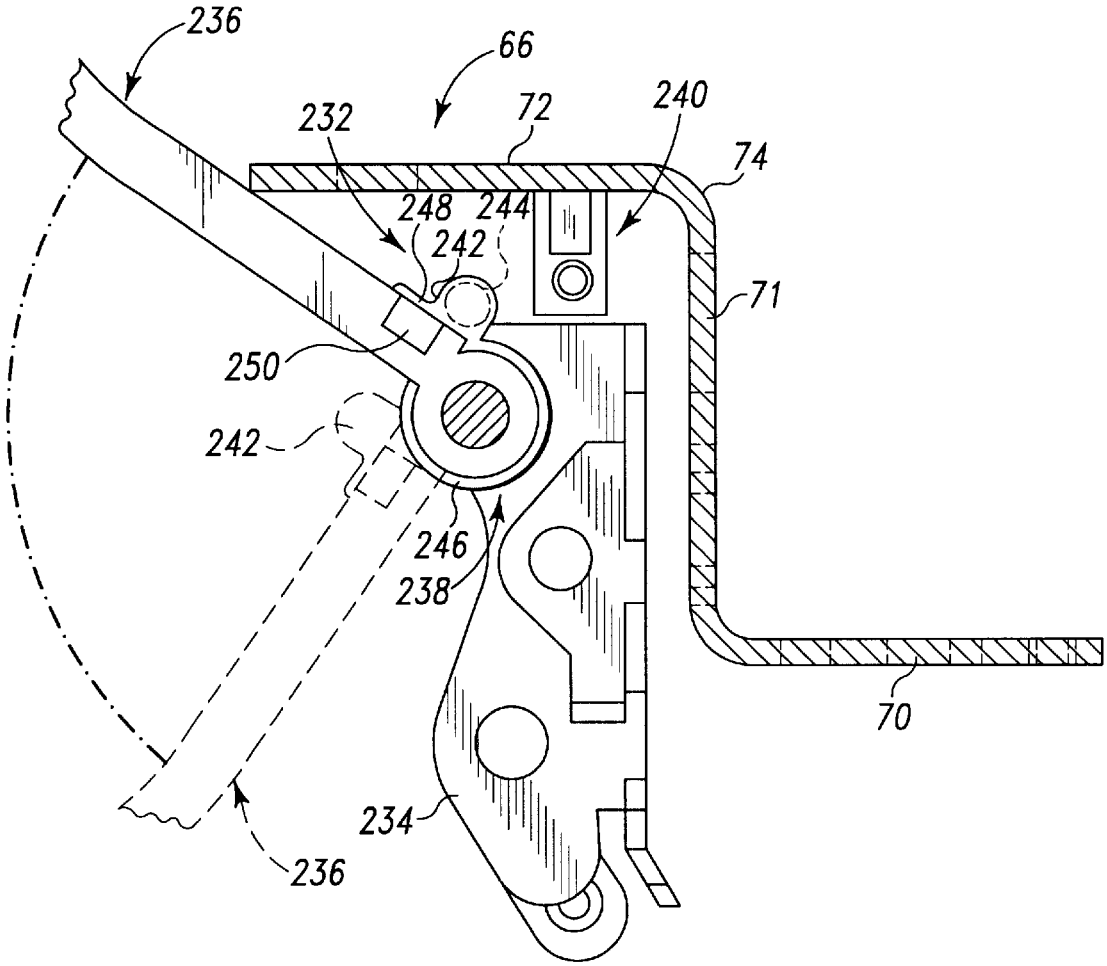
Figure 31:
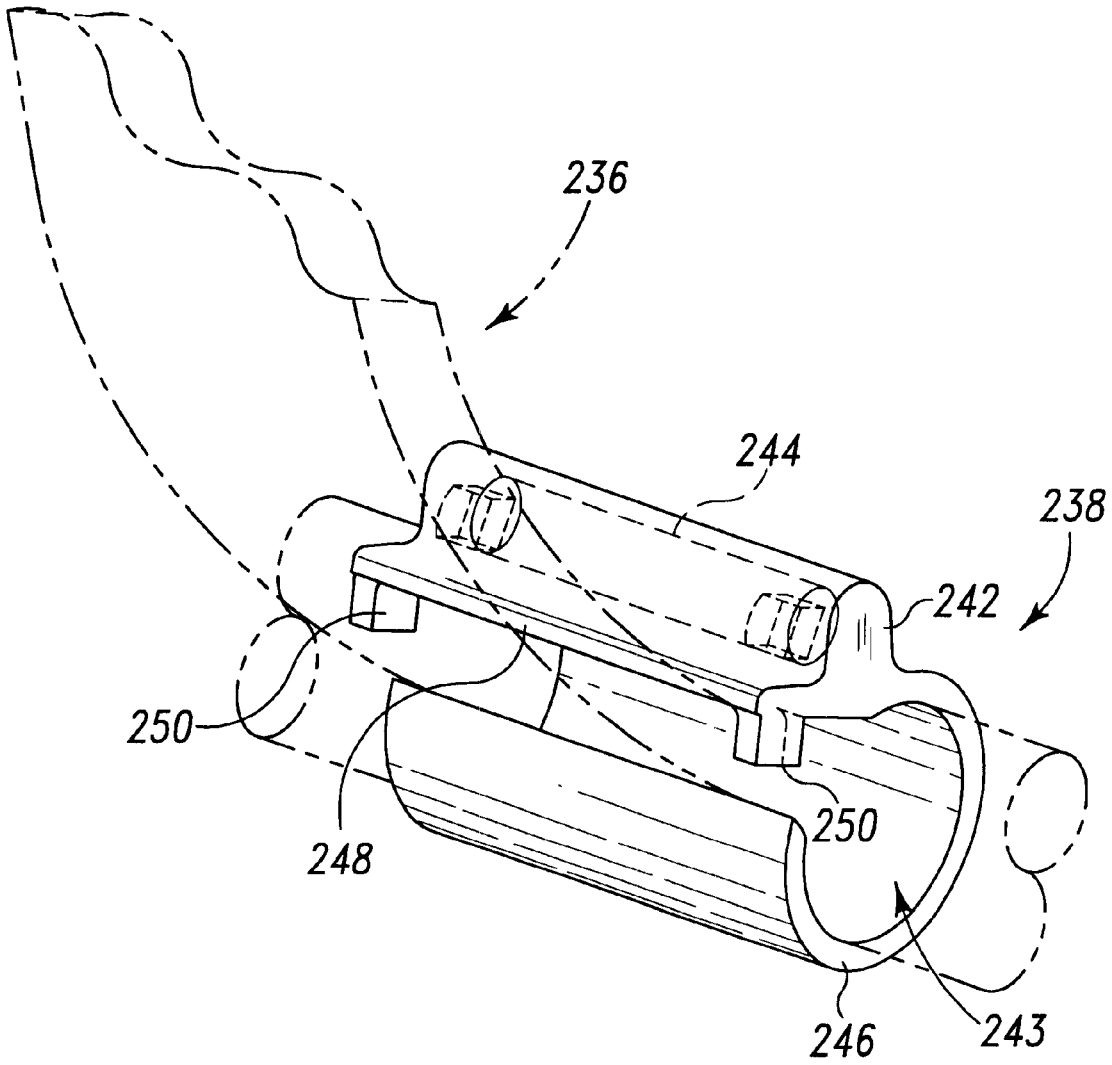
Figure 32:
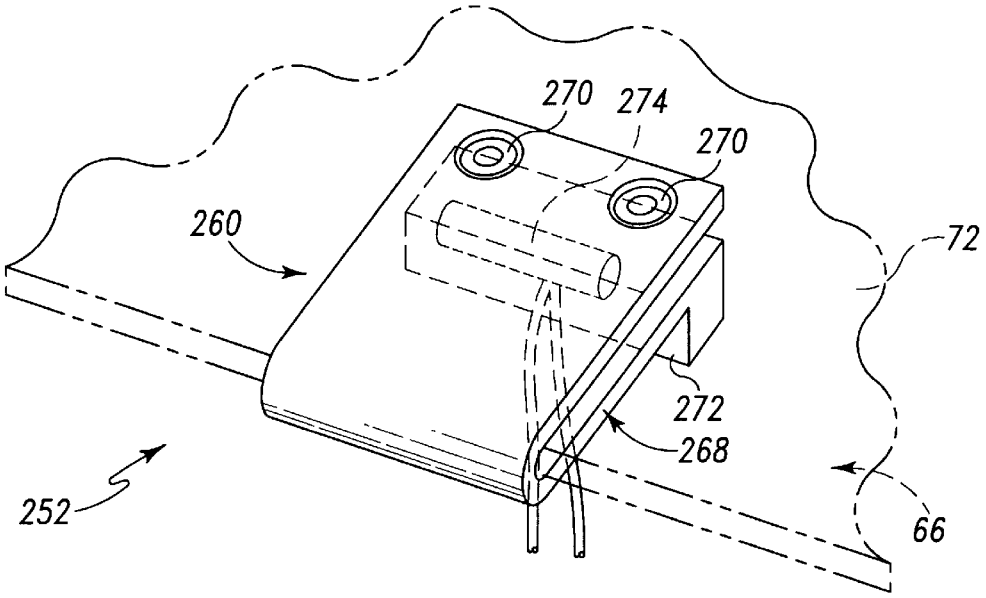
Figure 33:
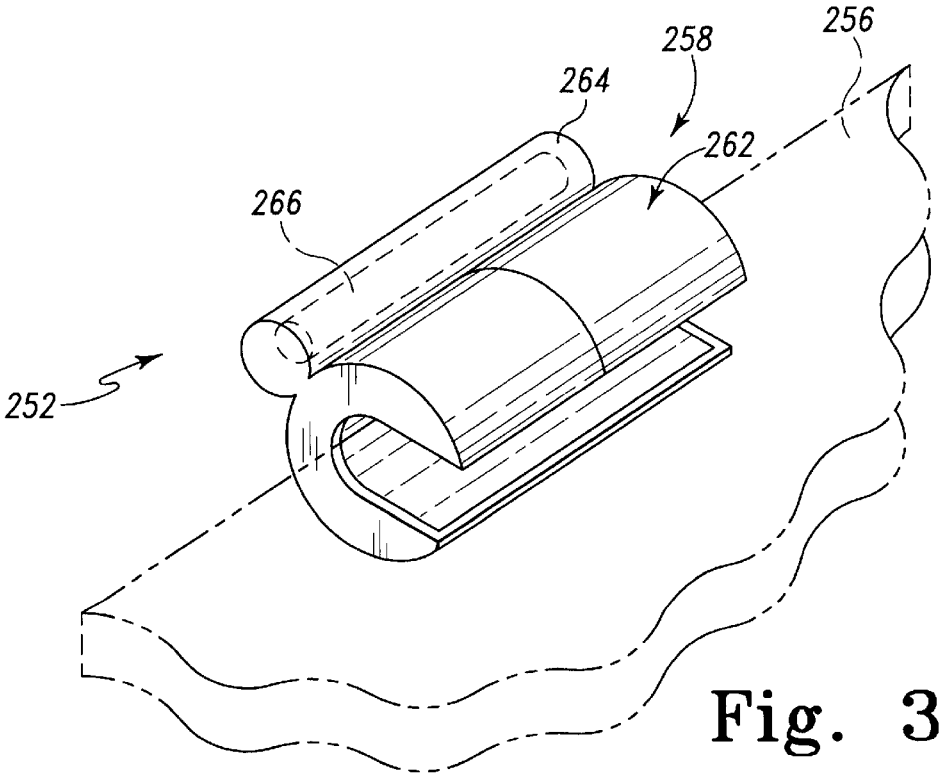
Figure 34:
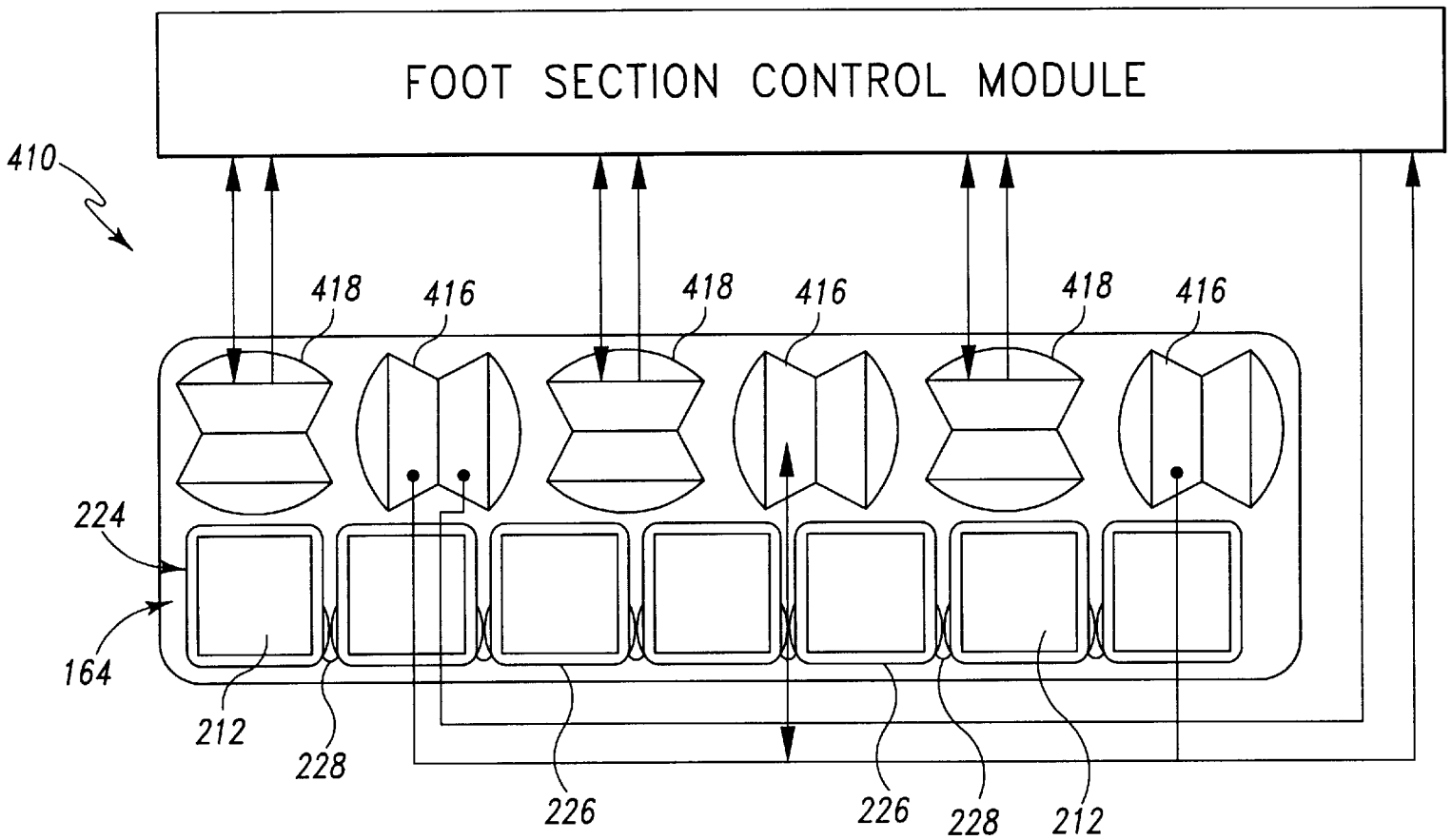

FIG. 12 is an exploded perspective view of the mattress of the present disclosure illustrating various components of the mattress (with the cover removed);

FIG. 13 is a side elevation view of the components of the mattress (with the cover removed);

FIG. 14 is an exploded perspective view of an alternative embodiment head portion of a mattress;

FIG. 15 is a diagrammatic end view taken along lines 15—15 of FIG. 1 showing a head portion of the mattress (with the cover removed) positioned on the head section of the deck, the head portion including a centrally located bladder positioned under the patient's head and a plurality of foam layers;

FIG. 16 is a view similar to FIG. 15 showing the bladder slightly deflated;

FIG. 17 is a diagrammatic view taken along line 17—17 of FIG. 1, showing a torso portion of the mattress (with the cover removed) during normal operation of the bed, the mattress including a pair of normally inflated right and left working bladders and normally deflated right and left boost bladders positioned under the working bladders;

FIG. 18 is a view similar to FIG. 17 showing the torso portion of the mattress during the first phase of rotational therapy with the right working and boost bladders inflated and the left working and boost bladders deflated so that the right portion of the mattress is positioned higher than the left portion of the mattress;

FIG. 19 is a view similar to FIG. 17 showing the torso portion of the mattress during the second phase of rotational therapy with the left working and boost bladders inflated and the right working and boost bladders deflated so that the left portion of the mattress is positioned higher than the right portion of the mattress;

FIG. 20 is a diagrammatic view taken along line 20—20 of FIG. 1, showing a thigh portion of the mattress (with the cover removed) during normal operation of the bed, the normally inflated working bladders, and the normally deflated boost bladders positioned under the working bladders;

FIG. 21 is a view similar to FIG. 20 showing the thigh portion of the mattress during the first phase of rotational therapy with the right working and boost bladders inflated and the left working and boost bladders deflated so that the right portion of the mattress is positioned higher than the left portion of the mattress;

FIG. 22 is a view similar to FIG. 20 showing the thigh portion of the mattress during the second phase of rotational therapy with the left working and boost bladders inflated and the right working and boost bladders deflated so that the left portion of the mattress is positioned higher than the right portion of the mattress;

FIG. 23 is a diagrammatic view taken along line 23—23 of FIG. 1 showing a foot portion of the mattress (with the cover removed) positioned on the foot section of the deck during normal operation of the bed, and the foot portion including a pair of boost bladders in a deflated position;

FIG. 24 is a view similar to FIG. 23 showing the foot portion of the mattress during the first phase of rotational therapy with the right boost bladder inflated and the left boost bladder deflated to raise the right portion of the mattress higher than the left portion of the mattress;

FIG. 25 is a view similar to FIG. 23 showing the foot portion of the mattress during the second phase of rotational therapy with the left boost bladder inflated and the right boost bladder deflated to raise the left portion of the mattress higher than the right portion of the mattress;

FIG. 26 is a diagrammatic view showing the foot section control module coupled to a peer-to-peer network and several other control modules coupled to the foot section control module so that a master/slave relationship exists therebetween;

FIG. 27 is a diagrammatic view showing one half of a preferred embodiment control module configuration;

FIG. 28 is a diagrammatic view showing the other half of the preferred embodiment control module configuration;

FIG. 29 is a diagrammatic view of the deck and a foot section position detector coupled to the deck to detect changes in position of the foot section;

FIG. 30 is a side elevation view of a representative siderail (with portions broken away) coupled to the deck showing a link of the siderail moved between an up position (solid lines) and a down position (phantom lines), the bed including a siderail position detector including a sensor having a clip coupled to a proximal end of the link and a switch coupled to the deck;

FIG. 31 is a perspective view of the clip of FIG. 30 showing the clip coupled to the proximal end of the siderail link (in phantom);

FIG. 32 is a perspective view of an alternative embodiment switch having a clip coupled to the deck;

FIG. 33 is a perspective view of an alternative embodiment clip coupled to a siderail component; and FIG. 34 is a diagrammatic view of an alternative embodiment foot section control module and bladder configuration of the foot portions of the mattress.

DETAILED DESCRIPTION OF THE INVENTION

A chair bed 10 in accordance with the present disclosure having a head end 12, a foot end 14, and right and left sides 16, 18 is illustrated in FIG. 1. As used in this description, the phrase "head end 12" will be used to denote the end of any referred-to object that is positioned nearest head end 12 of chair bed 10. Likewise, the phrase "foot end 14" will be used to denote the end of any referred-to object that is positioned nearest foot end 14 of chair bed 10.

Figure 2:
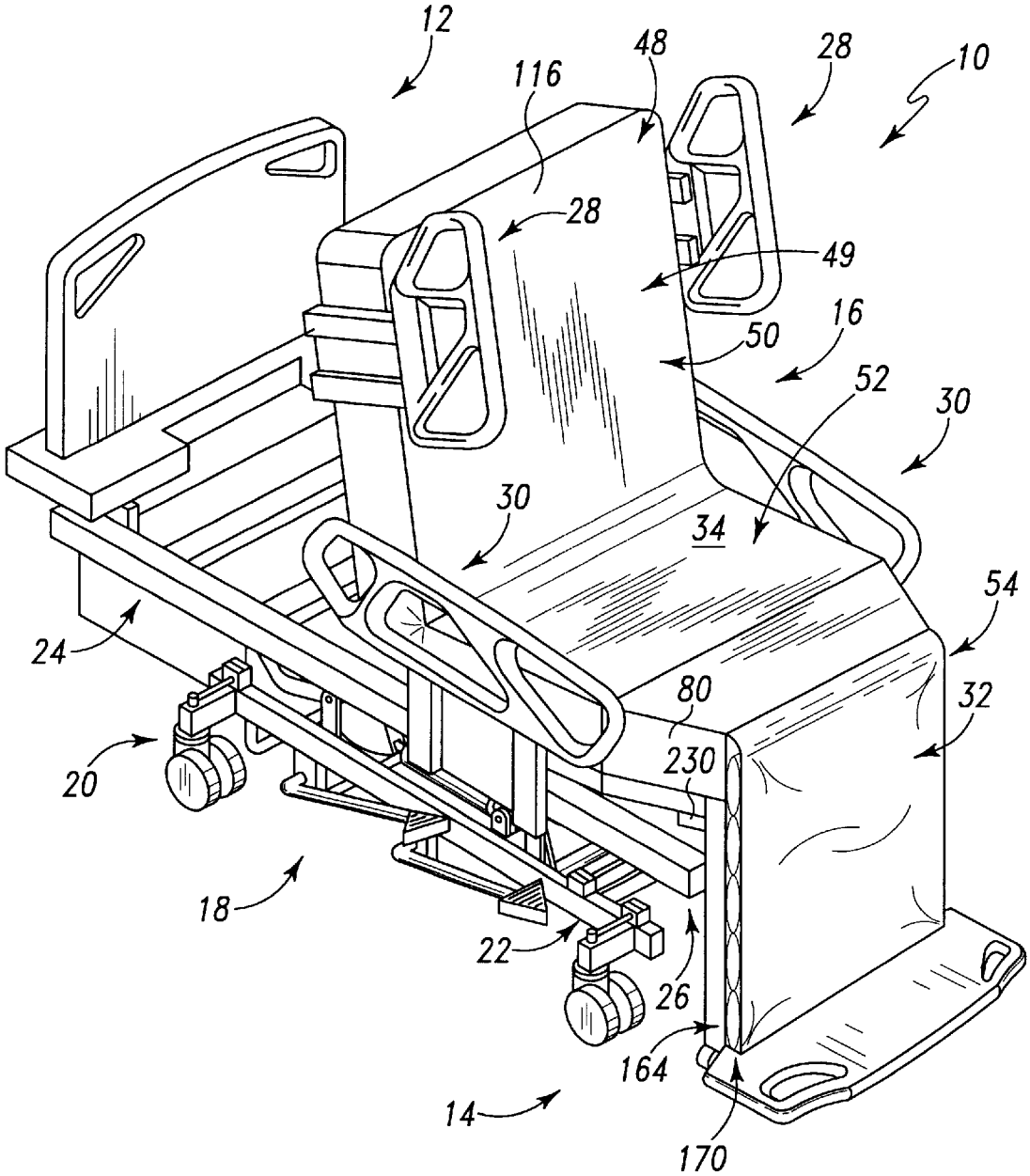
FIG. 2 is a view similar to FIG. 1 showing the chair bed in the sitting position having a head section of an articulating deck moved upwardly to a back-support position, a thigh section of the deck inclined slightly upwardly, a foot section of the deck moved to a generally vertical downwardly extending down position, and a foot portion of the mattress (with portion broken away) being deflated.

Chair bed 10 includes a bedframe 20 having a base frame 22 and an intermediate frame 24 connected to base frame 22 by lift arms as shown in FIGS. 1 and 2. Bedframe 20 further includes an articulating deck 26 coupled to intermediate frame 24. Chairbed 10 further includes head and foot end siderails 28, 30 that are coupled to bedframe 22 and a mattress 32 positioned on articulating deck 26 that provides a sleeping surface or support surface 34 configured to support a person (not shown).

Chair bed 10 can be manipulated, either by a caregiver or a person (not shown) on support surface 34, using a hydraulic system so that mattress 32 and articulating deck 26 assume a variety of positions, several of which are shown diagrammatically in FIGS. 3–8. Additional description of the hydraulic system and the remainder of bedframe 20 is disclosed in U.S. Pat. No. 5,715,548 to Weismiller et al., the disclosure of which is expressly incorporated by reference herein.

Articulating deck 26 includes a head section 40 having a head portion 41 and a torso portion 43, a seat section 42, a thigh section 44, and a foot section 46. Mattress 32 rests on deck 26 and includes a head portion 48, a torso portion 49, a seat portion 50, a thigh portion 52, and a foot portion 54, each of which generally corresponds to the like-named sections/portions of deck 26, and each of which is generally associated with the head, torso, seat, thighs, and feet of the person on support surface 34. Details of deck 26 and mattress 32 will be explained hereinafter.

Figure 3:
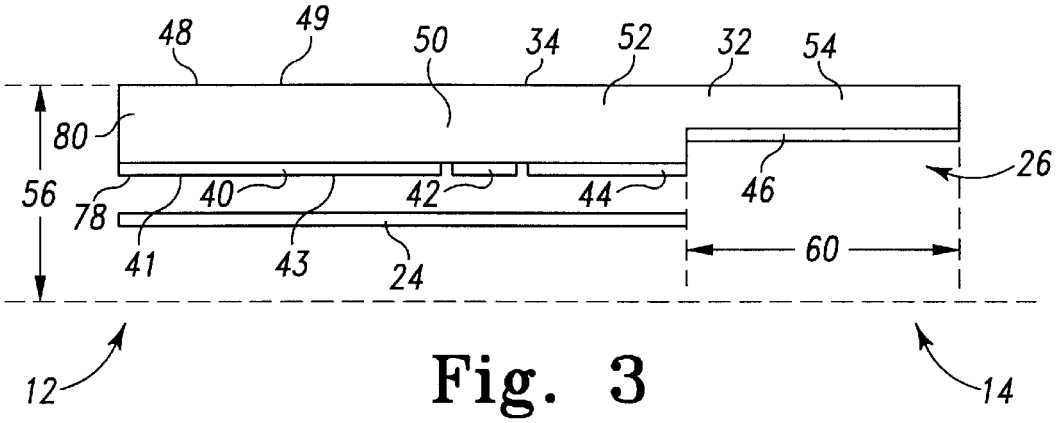
FIG. 3 is a diagrammatic view of the chair bed of FIG. 1 showing the chair bed in the bed position including a mattress having an upwardly-facing support surface held a predetermined first distance above the floor, the deck being in an initial position supporting the support surface in a generally planar configuration, and the foot section being a first length.
Figure 4:
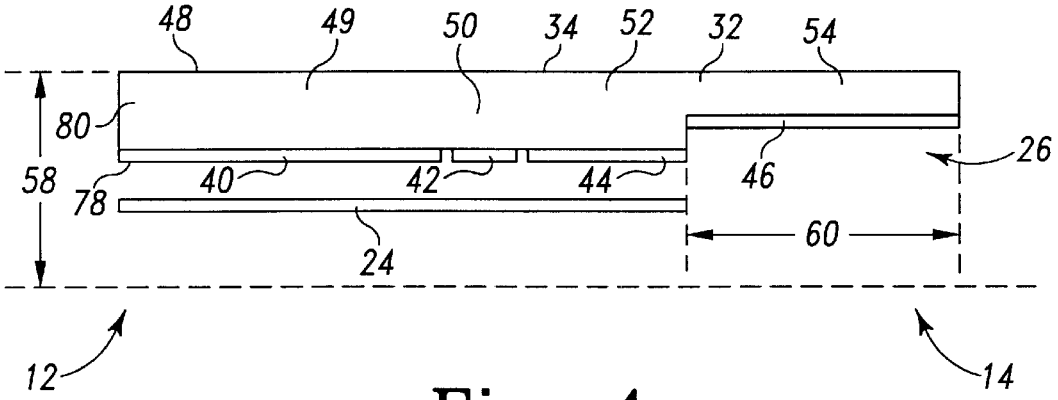
FIG. 4 is a diagrammatic view showing the chair bed in a low position.

Chair bed 10 can assume a bed position having deck 26 configured so that support surface 34 is planar and horizontal, defining an initial position of deck 26 with all sections 40, 42, 44, 46 of deck 26 substantially horizontal as shown in FIG. 1 and as shown diagrammatically in FIG. 3. In the bed position, support surface 34 is a predetermined first distance 56 above the floor. Chair bed 10 can also be manipulated to assume a low position shown diagrammatically in FIG. 4 having deck 26 in the initial position and having support surface 34 a predetermined second distance 58 above the floor, second distance 58 being smaller than first distance 56. Foot section 46 of articulating deck 26 has a first length 60 when the deck 26 is in the initial position.

Figure 5:
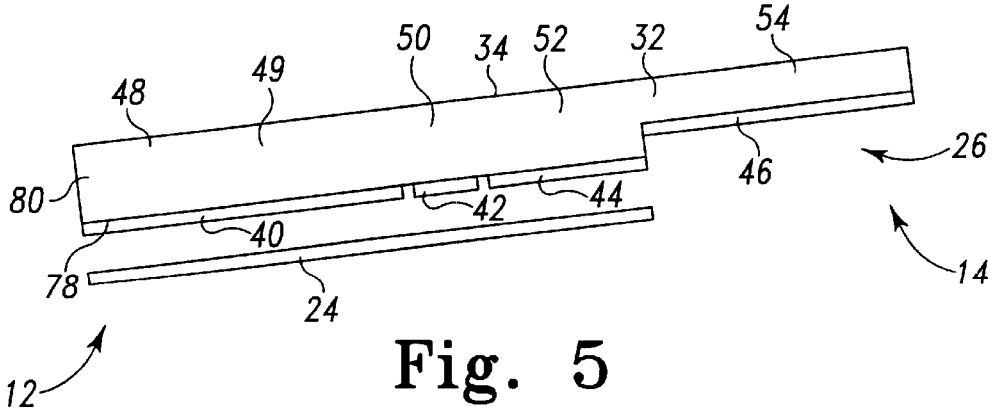
FIG. 5 is a diagrammatic view showing the chair bed in a Trendelenburg position.
Figure 6:
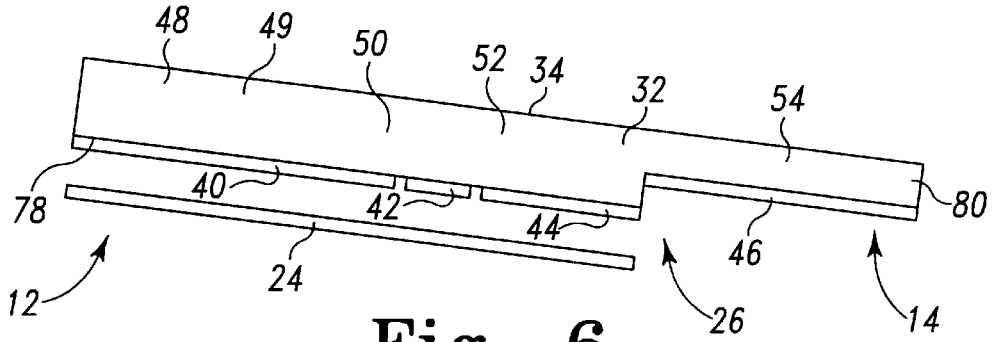
FIG. 6 is a diagrammatic view showing the chair bed in a reverse-Trendelenburg position.

Chair bed 10 can be moved to a Trendelenburg position shown diagrammatically in FIG. 5 having deck 26 in a planar configuration and tilted so that head end 12 of support surface 34 is positioned closer to the floor than foot end 14 of support surface 34. Chair bed 10 can also achieve a reverse-Trendelenburg position shown diagrammatically in FIG. 6 having deck 26 in a planar configuration and tilted so that foot end 14 of support surface 34 is positioned closer to the floor than head end 12 of support surface 34.

Figure 8:
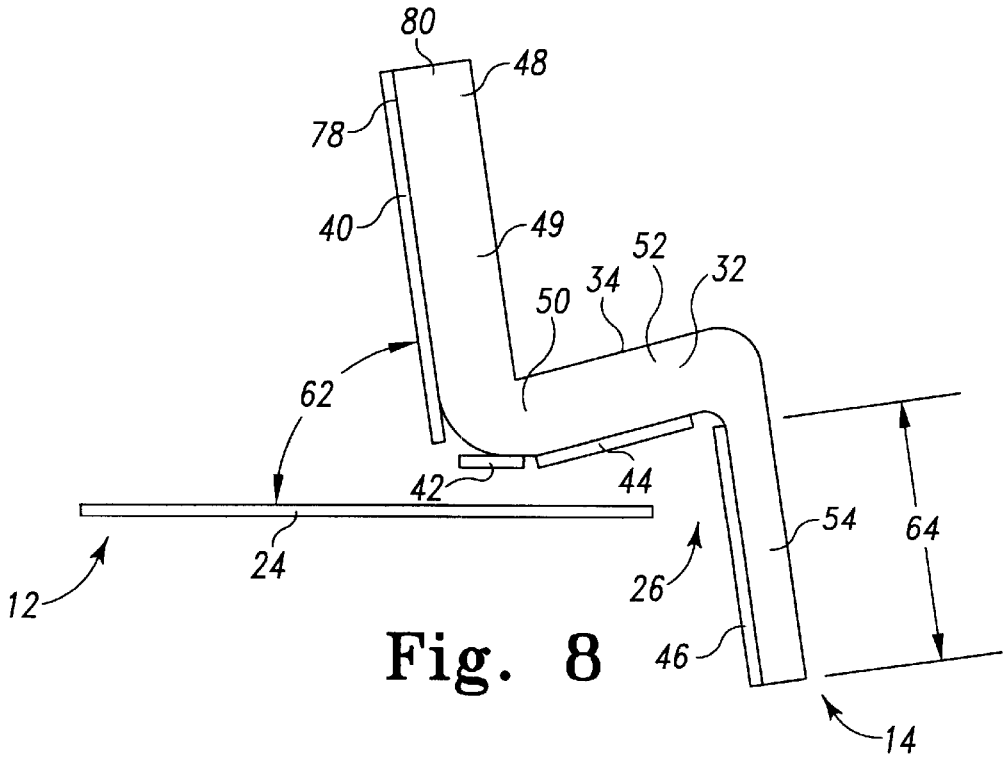
FIG. 8 is a diagrammatic view showing the chair bed in a sitting or chair position with the head end of the head section pivoted upwardly away from the seat section to the back-support position, the seat section lying generally horizontal as in the initial deck position, the thigh section being raised upwardly, the foot section extending downwardly from the thigh section and being a second shorter length, and the portion of the mattress over the foot section being deflated.

As described above, chair bed 10 is convertible to a chair position shown in FIG. 2 and shown diagrammatically in FIG. 8. In the chair position, head end 12 of head section 40 of deck 26 is pivoted upwardly away from intermediate frame 24 to a back-support position providing a pivotable backrest so that head section 40 and intermediate frame 24 form an angle 62 generally between 55 and 90 degrees. Seat section 42 of deck 26 is positioned generally horizontally as in the initial position, foot end 14 of thigh section 44 is slightly upwardly inclined, and foot section 46 of deck 26 extends generally vertically downwardly from thigh section 44 and has a second length 64 that is shorter than first length 60 when deck 26 is in the initial position.

Chair bed 10 is capable of assuming positions in which head, thigh, and foot sections 40, 44, 46 of deck 26 are in positions intermediate to those shown in FIGS. 3–6 and 8. For example, chair bed 10 can assume an intermediate position shown diagrammatically in FIG. 7, having head end 12 of head section 40 of deck 26 pivoted slightly upwardly from the initial position, seat section 42 positioned in the same generally horizontal plane as in the initial position, foot end 14 of thigh section 44 raised slightly upwardly from the initial position, and foot section 46 being inclined so that foot end 14 of foot section 46 lies below head end 12 of foot section 46. Additional disclosure of articulating deck 26 is disclosed in U.S. Pat. No. 5,715,548.

Figure 7:
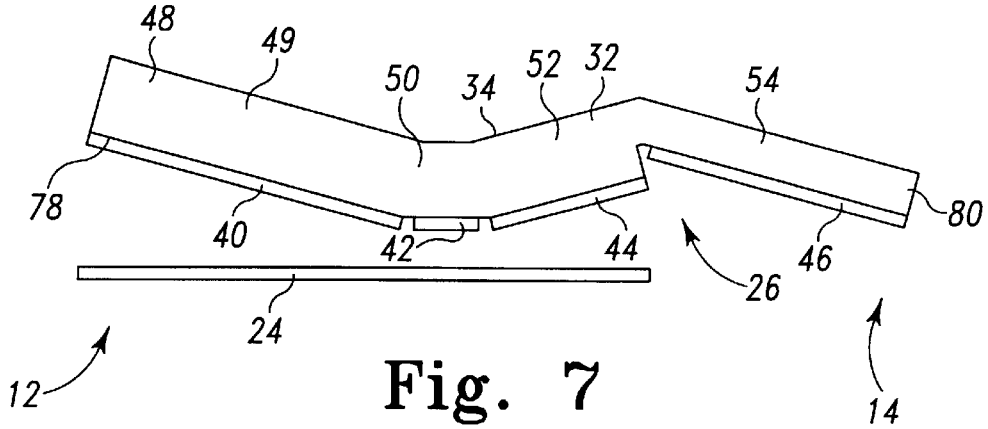
FIG. 7 is a diagrammatic view showing the chair bed in an intermediate position having the head end of the head section of the deck pivoted slightly upward from the initial position of the deck, a seat section positioned in the horizontal plane defined by the seat section in the initial position of the deck, and the foot section being inclined slightly so that the foot end of the foot section lies below the position of the foot section when the deck is in the initial position of the deck.

Thigh section 44 of articulating deck 26 is movable between a generally horizontal down position and a slightly inclined up position shown diagrammatically in FIG. 7. Although thigh section 44 can move independently of the head and foot sections 40, 46, thigh section 44 preferably moves to the upward position when head section 40 moves to the back-support position so that the head and thigh sections 40, 44 cooperate to cradle the person (not shown) on support surface 34 therebetween. Thigh section 44 preferably moves to the down position when head section 40 moves to the down position.

Figure 9:
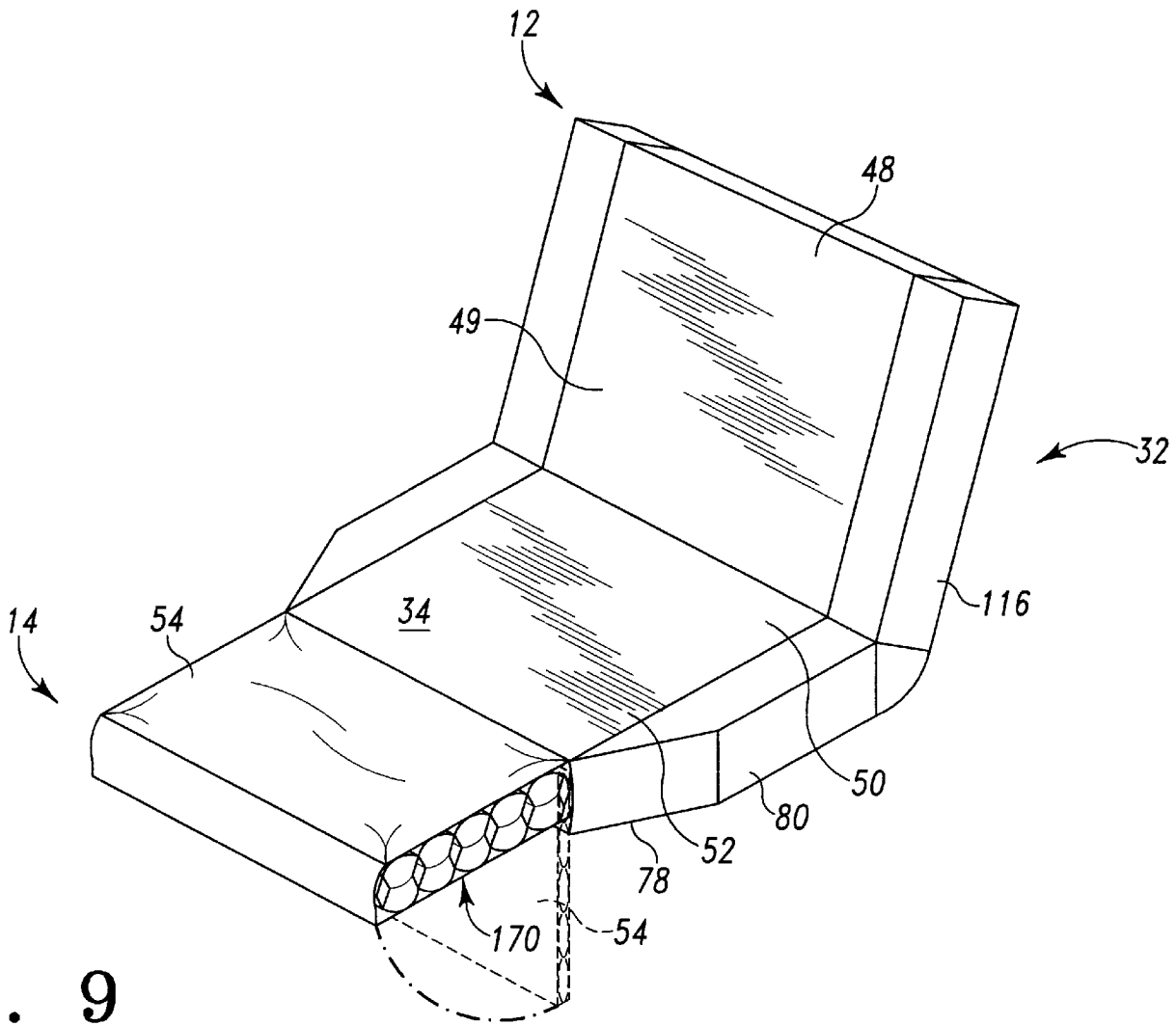
FIG. 9 is a perspective view of the mattress showing a foot portion of the mattress lowered (phantom lines) when the bed is in the chair position.
Figure 10:
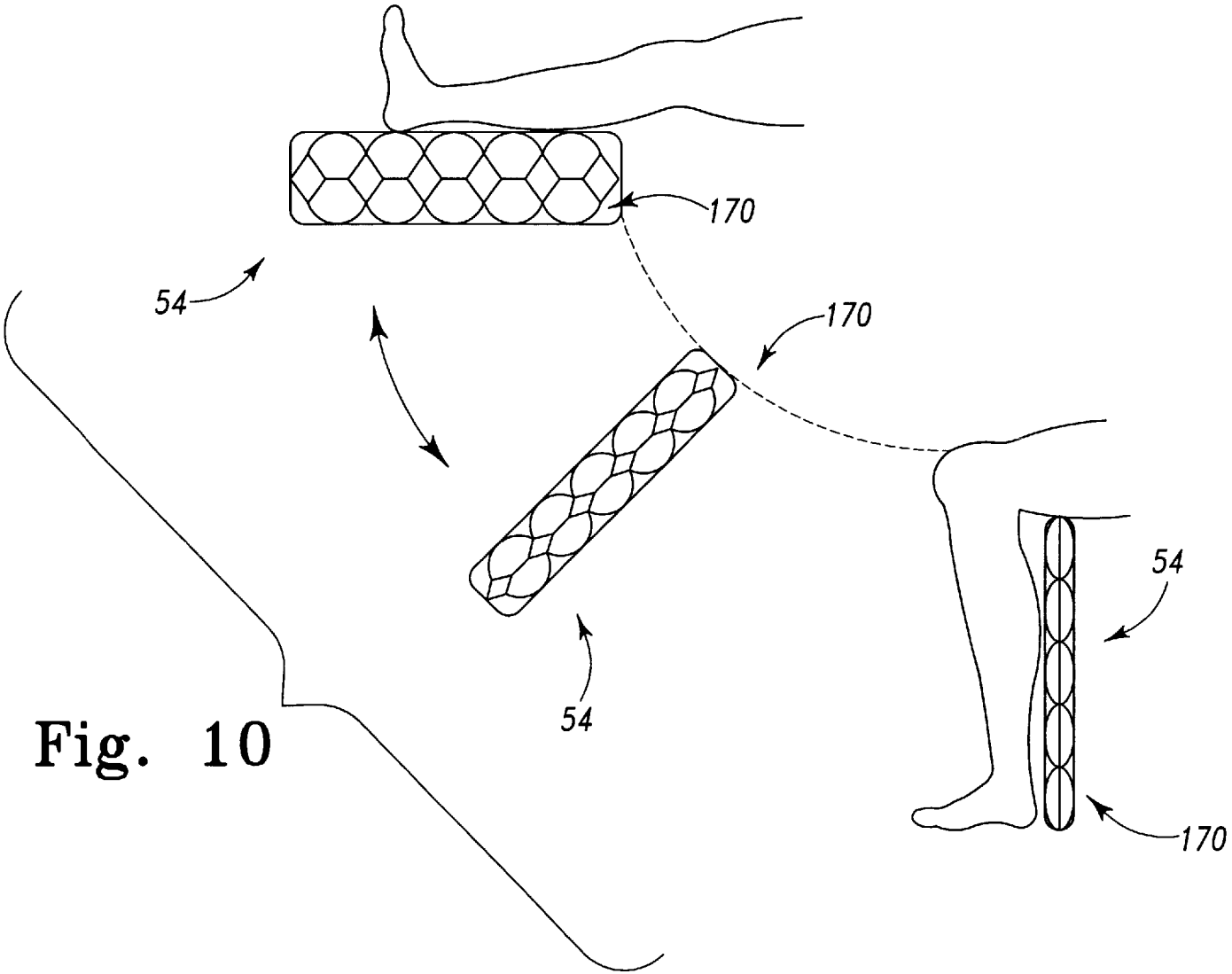
FIG. 10 is a diagrammatic view illustrating the foot portion of the mattress in an inflated position when the bed is in the normal bed position, the foot section of the deck in a retracted position, and the foot portion in a collapsed position when the bed is in the chair position.

Foot section 46 of articulating deck 26 is movable from a generally horizontal up position parallel to intermediate frame 24, as shown in FIGS. 1 and 10, to a generally vertically downwardly extending down position to permit the lower legs and feet of the person to be lowered to the sitting position as shown in FIGS. 2, 8, and 10. Foot section 46 can also be retracted from an extended position having first length 60, as shown in FIG. 3, to a retracted position having foot end 14 of foot section 46 drawn inwardly toward head end 12 of chair bed 10 so that foot section 46 has second length 64 that will "clear" the floor when foot section 46 moves to the down position as shown in FIGS. 8–10. Preferably, second length 64 of foot section 46 when foot section 46 is retracted is such that foot end 14 of foot section 46 clears the floor and is spaced-apart therefrom sufficiently to permit a base (not shown) of an over bed table (not shown) to fit therebetween.

As foot section 46 pivots from the up position to the down position, inflatable foot portion 54 of mattress 32 deflates, as shown in FIGS. 8–10, so that foot section 46 of articulating deck 26 can move to the down position without interference from foot portion 54 of mattress 32. Deflating foot portion 54 also allows the person (not shown) carried by chair bed 10 to sit on chair bed 10 when chair bed 10 moves to the sitting position without having the thickness of foot portion 54 of mattress 32 pull the knees and shins of the person forward as foot section 46 of articulating deck 26 pivots to the down position. In addition, the deflating action of deflating foot portion 54 prevents scrubbing between support surface 34 and the legs (not shown) of the person on support surface 34 by allowing support surface 34 adjacent foot portion 54 to move with the legs of the person. Additional description of foot section 46 of deck 26 is described in U.S. Pat. No. 5,715,548.

Additionally, articulating deck 26 of chair bed 10 is configured as a step deck as shown in FIG. 12. Torso portion 43 of head section 40 and seat and thigh sections 42, 44 of step deck 26 include an upper deck 66, a central, longitudinally extending recess 68 defined by a lower deck 70 of step deck 26, and a wall 71 surrounding recess 68 and connecting lower deck 70 to upper deck 66. Upper deck 66 includes longitudinally extending upper deck side portions 72 defining a ledge 74. Head portion 41 of head section 40 and foot section 46 are substantially flat and coplanar with upper deck side portions 72 when bed 10 is in the bed position as shown in FIG. 13.

Mattress 32 includes generally upwardly-facing support surface 34 and a bottom surface 78 that is generally parallel to support surface 34 and positioned beneath support surface 34. A perimeter side 80 connects support surface 34 and bottom surface 78. Additional disclosure of mattress 32 is discussed below.

Siderails 28, 30 are passive restraint devices mounted on both sides of chair bed 10 as shown in FIGS. 1 and 2. In the up patient-restraining position, siderails 28, 30 are vertical barriers extending above support surface 34 to restrain movement of the person past sides 80 of support surface 34. Siderails 28, 30 may also be lowered to a down position below support surface 34 of mattress 32 to permit the person to move past sides 80 of mattress 32 when entering and exiting chair bed 10 or to give the caregiver clear access to the patient. Siderails 28, 30 can thus rotate between an up patient-restraining position abutting side 80 of mattress 32, as shown in FIG. 1, to a down tucked position beneath side portions 72 of upper deck 66, as shown in FIG. 1, with the right side head end siderail 28.

Head end siderails 28 are mounted to head section 40 of articulating deck 26, and foot end siderails 30 are mounted to move or stay with seat section 42 of deck 26. Head end siderails 28 move with head section 40 of deck 26 as head section 40 pivots between the down position and the back-support position. Foot end siderails 30 are generally fixed in an angular orientation relative to intermediate frame 24. Additional description of siderails 28, 30 is provided in U.S. Pat. 5,715,548.

Mattress 32 is configured to provide support and treatment to a patient while also permitting articulating deck 26 to move to the chair position. Mattress 32 includes several inflatable treatment apparatus for providing several types of therapy. Mattress 32 includes a rotational therapy device 110 for providing pulmonary rotational therapy, a pulsation therapy device 112 for providing percussion and/or vibration therapy, and a treatment device 114 for providing decubitus ulcer (bedsore) treatment and prevention.

Mattress 32 includes a cover 116 defining support surface 34, perimeter side 80, and bottom surface 78. Head portion 48 of mattress 32 is positioned over head portion 41 of head section 40 of deck 26. Head portion 48 includes a lower foam layer 118 positioned on top of a bottom surface of cover 116. Head portion 48 further includes a first intermediate foam layer 122 positioned on top of lower foam layer 118. A multi-component second intermediate foam layer 124 is positioned on top of first intermediate foam layer 122 and includes first, second, and third portions 126, 128, 130 as shown in FIG. 12.

Head portion 48 further includes an inflatable head bladder 132 positioned on top of second portion 128 of second intermediate foam layer 124. Head bladder 132 includes air tubes 180 positioned adjacent cover 116. Head portion 48 further includes first and second foam blocks 134, 136 positioned on opposite sides of inflatable head bladder 132. Head portion 48 further includes a pair of vertically oriented foam blocks 137 positioned on opposite sides of first and second intermediate foam layers 122, 124 and first and second foam blocks 134, 136 as shown in FIGS. 15 and 16.

Foam blocks 137 are made of a more rigid foam material to provide a "fence" configured to direct a patient's head away from the sides of head portion 48. Foam layer 118 is made of a stiffer material than first intermediate foam layer 122. First and third portions 126, 130 of second intermediate foam layer 124 are made of a less stiff material than first intermediate foam layer 127 and second portion 128 is made of a less stiff material than first and third portions 126, 130. First and second foam blocks 134, 136 are made of a stiff material that is less stiff than second portion 128. Thus, head portion 48 of mattress 34 is provided with a stiffness gradient. According to an alternative embodiment, the foam components are made of other resilient materials.

An alternative embodiment head portion 310 for use with a mattress is shown in FIG. 14. Head portion 310 includes a lower foam layer 312 positioned on top of a bottom surface of cover 110. Head portion 310 further includes a first intermediate foam layer 314 positioned on top of lower foam layer 312. A multi-component second intermediate foam layer 316 is positioned on top of first intermediate foam layer 314 and includes first, second, and third portions 318, 320, 322. A top foam layer 324 is positioned on second intermediate foam layer 314.

Head portion 310 includes an inflatable head bladder 326 positioned on top foam layer 324. Head portion 310 further includes a pair of vertically oriented foam blocks 328 positioned on opposite sides of first and second intermediate foam layers 314, 316 and top foam layer 324 and a vertically oriented foam panel 330 positioned on a head end of first and second intermediate foam layers 314, 316 and top foam layer 324.

Foam blocks 328 and foam panel 330 are made of a more rigid foam material to provide a "fence" configured to direct a patient's head away from the sides of head portion 310. Lower foam layer 312 is made of a stiffer material than first intermediate foam layer 314. First and third portions 318, 322 of second intermediate foam layer 316 are made of a less stiff material than first intermediate foam layer 314 and second portion 320 is made of a less stiff material than first and third portions 318, 322. Top foam layer 324 is made of material that is less stiff than second portion 320.

Torso, seat, and thigh portions 49, 50, 52 of mattress 32 share several components. For example, torso, seat, and thigh portions 49, 50, 52 includes a two component foam panel 138 positioned on top of cover 116. Foam panel 138 is sized to substantially fill in recess 68 of deck 26 as shown in FIGS. 12 and 17–22. Foam panel 138 includes a recess 139 that houses conduits (not shown) which couple to the various inflatable bladders. Torso, seat, and thigh portions 49, 50, 52 also share inflatable bolsters 140 positioned over side portions 72 of deck 26 as shown in FIGS. 17–22.

Torso, seat, and thigh portions 49, 50, 52 also share first and second top foam layers 142, 144. These foam layers 142, 144 are positioned adjacent support surface 34 of cover 116, terminate short of head and foot portions 48, 54 of mattress 32, and extend over side portions 72 of deck 26. First layer foam layer 142 is made of a less stiff material than second foam layer 144.

Torso portion 49 of mattress 32 also includes several components of the various inflatable treatment apparatus. Mattress 32 includes a treatment bladder 149 and right and left working bladders 145, 147 positioned over torso portion 43 of head section 40 and seat and thigh sections 42, 44 of deck 26 as shown in FIG. 12. Mattress 32 also includes right and left boost bladders 151, 153 positioned over torso portion 43 of head section 40 and seat and thigh sections 42, 44 of deck 26.

Treatment bladder 149 is divided into first, second, and third treatment zones 154, 165, 175 that are independently inflated and deflated as will be discussed in greater detail below. Right and left boost bladders 151, 153 each include respective first and second bladder sections 146, 156, 148, 158. Mattress 32 further includes right and left boost bladders 166, 168 positioned in foot portion 54 of mattress 32 that are in fluid communication with respective right and left boost bladders 151, 153.

Torso portion 49 includes first sections 146, 148 of right and left boost bladders 151, 153 positioned on right and left sides of mattress 34 that are deflated during normal operation of bed 10. Torso portion 49 further includes portions of right and left working bladders 145 147 positioned under second foam layer 144 and over boost bladders 146, 148 on right and left sides of mattress 34 that are inflated during normal operation of bed 10. Torso portion 49 also includes first treatment zone 154 of treatment bladder 149 positioned over each working bladder 145, 147. Torso portion 49 further includes a pulsation bladder 155 positioned between cover 116 and first foam layer 142.

As shown in FIG. 12, seat portion 50 includes portions of second boost bladder sections 156, 158 positioned on right and left sides of mattress 34 that are deflated during normal operation of bed 10. Seat portion 50 includes portions of right and left working bladders 145, 147 positioned under second foam layer 144 and over second sections 156, 158 of right and left boost bladders 151, 153 on right and left sides of mattress 34. These portions of working bladders 145, 147 are inflated during normal operation of bed 10. Seat portion 50 also includes second treatment zone 165 of treatment bladder 149 positioned over right and left working bladders 145, 147.

Similar to seat portion 50, thigh portion 52 of mattress 32 also includes several components of the various inflatable treatment apparatus. As shown in FIG. 12, thigh portion 52 includes portions of second bladder sections 156, 158 of right and left boost bladders 151, 153 positioned on right and left sides of mattress 34. Thigh portion 52 further includes portions of first and second working bladders 145, 147 positioned under second foam layer 144 and over second boost bladder sections 156, 158 on right and left sides of mattress 34. Thigh portion 52 also includes third inflatable treatment zone 175 of treatment bladder 149 positioned over portions of working bladders 145, 147.

As shown in FIG. 12, foot portion 54 of mattress 32 includes right and left boost bladders 166, 168 positioned over foot section 46 of deck 26. A foot bladder 170 is positioned over right and left boost bladders 166, 168. Foot portion 54 further includes a layer of shear material 172 positioned over foot bladder 170.

Mattress 32 further includes a foam panel 174 providing a resilient component positioned between thigh and foot portions 52, 54 of mattress 32. Panel 174 substantially fills a gap that widens between thigh and foot portions 52, 54 when foot section 46 of deck 26 is lowered. Panel 174 is preferably positioned between second boost bladder sections 156, 158 and boost bladders 166, 168.

Bed 10 includes a peer-to-peer network 276 and several control modules which control the inflation and deflation of the bladders are coupled to the network 276, as shown in FIG. 31. A foot section control module 220 is permanently coupled to bed 10 and peer-to-peer network 276 to receive commands therefrom. Additional description of a suitable peer-to-peer network is disclosed in U.S. Pat. No. 5,715,548.

According to the presently preferred embodiment of the disclosure, a pulmonary pulsation control module 177, a pulmonary rotation control module 188, a normal operation control module 190, and a treatment therapy control module 113 are electrically coupled to foot section control module 220 and receive commands from peer-to-peer network 276 through foot section control module 220. Thus, a master-slave relationship exists between foot section control module 220 and pulmonary pulsation control module 177, pulmonary rotation control module 188, normal operation control module 190, and treatment therapy control module 113.

Inflatable head bladder 132, treatment bladder 149, foot bladder 170, and right and left working bladders 145, 147 are inflated during normal operation of bed 10 by treatment therapy and normal operation control modules 113, 190 as shown in FIGS. 9, 17, and 23. Boost bladders 151, 153, 166, 168 are deflated during normal operation of bed 10. During normal operation, head bladder 132, treatment bladder 149, foot bladder 170, and right and left working bladders 145, 147 maintain support surface 34 of cover 116 at a normal height 176 above deck 26, as shown in FIGS. 17 and 20, to support a patient positioned thereon.

Pulsation therapy device 112 is configured to provide vibration and/or percussion therapy to a patient. Pulsation therapy device 112 includes pulmonary pulsation control module 177 that provides predetermined pulsations of air to pulsation bladder 155 to quickly oscillate the pressure levels in pulsation bladder 155. Pulmonary pulsation control module 177 is coupled to pulsation bladder 155 by air conduits (not shown).

Pulsation bladder 155 includes three aligned air tubes 178 positioned between cover 116 and first and second foam layers 142, 144. Tubes 178 are oriented transverse to a longitudinal axis of bed 10. Each air tube 178 is in fluid communication with the other air tubes 178. According to alternative embodiments of the present disclosure, the pulsation bladder includes fewer or more tubes of alternative configurations.

To perform pulsation therapy, pulmonary pulsation control module 177 is coupled to bed 10 and air tubes 178 of pulsation bladder 155 are inflated as shown, for example, in FIG. 12. Air pulses or oscillations are then produced by the pulsation valve and sent through the conduit to air tubes 178 to provide the pulmonary percussion and vibration therapies. When pulmonary pulsation therapy is not being performed on the patient, pulmonary pulsation control module 177 is removed from bed 10 and pulsation bladder 155 is deflated to a substantially flat configuration as shown in FIGS. 17–19. Thus, pulsation therapy device 112 provides an inflatable treatment apparatus configured to rapidly move between inflated and deflated positions to provide pulsation therapy treatment to a patient positioned on support surface 34.

Treatment device 114 is configured to provide prevention and/or treatment of decubitus ulcers (bedsores). Treatment device 114 includes treatment therapy control module 113 having a set of valves that coordinates inflation and deflation of first, second, and third treatment zones 154, 165, 175 of treatment bladder 149 so that these longitudinally positioned treatment zones 154, 165, 175 oscillate between inflated and deflated positions to cause support surface 34 to undulate. Treatment therapy control module 113 is coupled to respective treatment zones 154, 165, 175 by air conduits. Preferred treatment therapy control module 113 is described in greater detail below.

Each treatment zone 154, 165, 175 includes a plurality of aligned air tubes 182, 184, 185. Air tubes 182, 184, 185 of first, second, and third treatment zones 154, 165, 175 are positioned between first and second foam layers 142, 144 and right and left working bladders 145, 147 as shown, for example, in FIG. 12. Tubes 182, 184, 185 are oriented transverse to a longitudinal axis of bed 10. Each air tube 182, 184, 185 of the respective groups is in fluid communication with the other air tubes of the group. Each group of air tubes 182, 184, 185 is in fluid communication with the set of valves of treatment therapy control module 113 to control the inflation and deflation of the respective treatment zones 154, 165, 175 of treatment bladder 149. According to alternative embodiments of the present disclosure, the treatment bladders include fewer or more tubes of alternative configurations.

To perform decubitus ulcer (bedsore) treatment, treatment therapy control module 113 is coupled to bed 10 so that treatment zones 154, 165, 175 are inflated and deflated to raise and lower different portions of the patient's body at different times and/or intervals. According to the presently preferred embodiment, the coordination of the oscillations creates a wave pattern as first, second, and third treatment zones 154, 165, 175 are sequentially inflated and deflated. The deflation and inflation of each treatment bladder may begin before, during, or after inflation/deflation of the proceeding treatment bladder. According to alternative embodiments, other patters of inflation and deflation of the treatment bladders is provided.

When treatment is complete, treatment therapy control module 113 is removed from bed 10. Thus, treatment device 114 provides an inflatable treatment apparatus configured to move between inflated and deflated positions to provide decubitus ulcer (bedsore) treatment and/or prevention to a patient positioned on support surface 34.

Pulmonary rotation therapy device 110 is configured to perform rotational therapy on a patient. Pulmonary rotation therapy device 110 includes pulmonary rotation control module 188 having a set of valves and right and left working bladders 145, 147, and companion right and left boost bladders 151, 153, 166, 168 positioned under and snapped to the respective right and left working bladders 145, 147. Pulmonary rotation control module 188 is coupled to respective boost bladders 151, 153, 166, 168 by air conduits (not shown) to control oscillations between the inflated and deflated positions. Normal operation control module 190 is coupled to right and left working bladders 145, 147 by conduits (not shown) and receives commands from pulmonary rotation control module 188 to coordinate inflation and deflation of right and left working bladders 145, 147 with inflation and deflation of respective boost bladders 151, 153, 166, 168.

Right working and boost bladders 145, 151, 166 positioned on the right side of mattress 32 cooperate to raise and lower the right portion of support surface 34. Similarly, left working and boost bladders 147, 153, 168 positioned on the left side of support surface 34 cooperate to raise and lower the left portion of support surface 34.

As previously mentioned, boost bladders 151, 153, 166, 168 are in a deflated position within mattress 32 until it is desired to treat the patient with rotational therapy, but right and left working bladders 145, 147 are normally inflated, as shown in FIGS. 17, 20, and 23. Thus, in the preferred embodiment, boost bladders 151, 153, 166, 168 do not provide support for support surface 34 during normal operation of bed 10. However, working bladders 145, 147 do provide support for support surface 34 during normal operation of bed 10 and during certain phases of the rotational therapy operation through normal operation control module 190. It is understood that in other embodiments of the disclosure, the boost bladders may be inflated to provide a support surface for the patient during normal operation and/or that the working bladders may be deflated during normal operation.

When it is desired to provide rotational treatment to the patient, pulmonary rotation control module 188 is moved to an attached position coupled to bed 10 to begin the rotational therapy operation. A graphical interactive display (not shown) of bed 10 or a graphic caregiver interface module (not shown) automatically recognizes that pulmonary rotation control module 188 is attached to bed 10. Therefore, controls for pulmonary rotation therapy device 110 can be actuated from the graphical interactive display or the graphic caregiver interface. Normal operation control module 190 is permanently coupled to bed 10 and maintains right and left working bladders 145, 147 in the inflated position during normal operation of bed 10.

FIGS. 17, 20, and 23 illustrate the configuration of rotational therapy device 110 during normal operation of bed 10 with boost bladders 151, 153, 166, 168 deflated or flat. FIGS. 18, 21, and 24 illustrate actuation of rotational therapy device 110 to a first phase of therapy to rotate a patient situated on support surface 34 of mattress 32 to the left. Pulmonary rotation control module 188 controls operation of normal operation control module 190 to fully inflate right working bladder 145 (if not already inflated from normal operation) and deflate left working bladder 147. Pulmonary rotation control module 188 deflates left boost bladders 153, 168 (if not already deflated from normal operation) and inflates right boost bladders 151, 166. This combination of inflation and deflation raises the right portion of support surface 34 to a raised height 192 that is greater than normal height 176 and lowers the left portion of support surface 34 to a lowered height 194 that is less than normal height 176.

FIGS. 19, 22, and 25 illustrate actuation of rotational therapy device 110 to a second phase of the rotational therapy operation to rotate a patient situated on support surface 34 of mattress 32 to the right after being positioned on the left side for a predetermined period of time. Pulmonary rotation control module 188 controls normal operation control module 190 to fully inflate left working bladder 147 and deflate right working bladder 145. Pulmonary rotation control module 188 inflates left boost bladders 153, 168 and deflates right boost bladders 151, 166.

The combination of inflation and deflation raises the left portion of support surface 34 to a raised height 196 that is greater than normal height 176 and lowers the right portion of support surface 34 to a lowered height 198 that is less than normal height 176. Between the first and second phases of (he rotational therapy operation, pulmonary rotation control module 188 and normal operation control module 190 inflate and deflate the respective bladders to the next respective position. During rotational therapy, head bladder 132 is slightly deflated to "cradle" the patient's head as shown in FIG. 16.

To end the rotational therapy operation, pulmonary rotation control module 188 is removed from bed 10 to a detached position so that boost bladders 151, 153, 166, 168 return to the deflated state (if not already deflated). Normal operation control module 190 returns working bladders 145, 147 to the inflated position as shown in FIGS. 17 and 20 so that the right and left sides of support surface 34 return to normal height 176. Thus, rotational therapy device 110 provides an inflatable treatment apparatus configured to move between inflated and deflated positions to provide pulmonary rotational therapy treatment to a patient positioned on support surface 34.

As shown, for example, in FIGS. 17 and 20, each bolster 140 includes four elongated bladders 210 bundled together. Bladders 210 remain inflated during normal use of bed 10 and during the various therapies. During rotational therapy, right and left sides of support surface 34 dip slightly below the upper surfaces of elongated bladders 210 so that bolsters 140 provide a fence preventing the patient from contacting siderails 28, 30. Bladders 210 are in fluid communication with third treatment zone 175.

Figure 11:
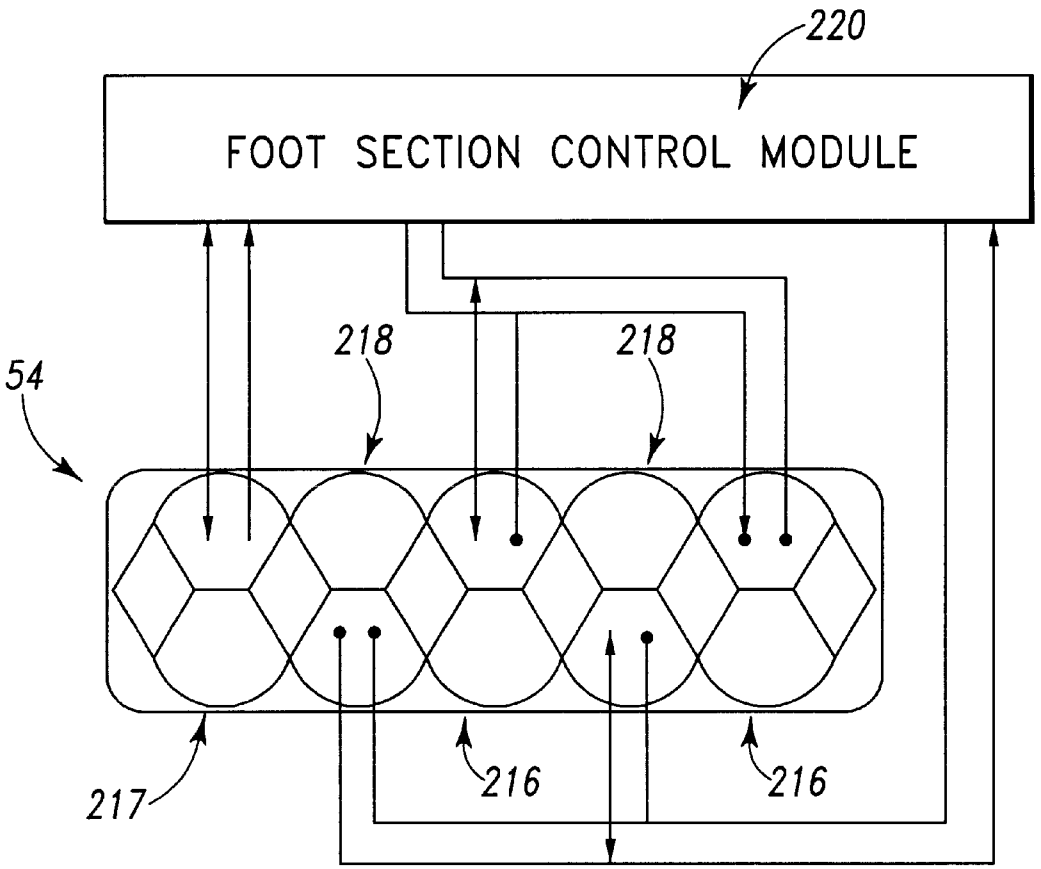
FIG. 11 is a diagrammatic view of a foot section control module and bladder configuration of the foot portion of the mattress.

Foot portion 54 of mattress 32 is particularly designed for use with chair bed 10 of the present disclosure that has retractable foot section 46 of deck 26. An alternative embodiment of foot portion 410 of mattress 32 is shown in FIG. 34. Air tubes 184 include a first set of air tubes 216, a second set of air tubes 218 alternately positioned with air tubes 216, and a heel bladder 217 positioned at the foot end of foot bladder 170 as shown in FIGS. 11 and 13. Air tubes 216, 218 are configured to collapse to a near zero dimension when air is withdrawn from tubes 216, 218.

This orientation of tubes 216, 218 in foot portion 54 of mattress 32 causes foot portion 54 to retract or shorten and to collapse or thin as tubes 216 are deflated by a foot section control module 220 as hospital bed 10 moves from the bed position to the chair position. In the chair position, foot section 46 of deck 26 and foot portion 54 of mattress 32 move from a generally horizontal position to a generally vertical, downwardly extending position. Preferably, foot section 46 moves from an extended position to a retracted position to shorten foot section 46 as articulating deck 26 of bed 10 moves to the chair configuration.

Heel tube 217 is configured to reduce the pressure on the heel of the patient. Because foot section 46 is retractable, heel tube 217 can be positioned under the heels of the patient by retracting foot section 46 until the patient's heels are positioned over heel tube 217. Foot section control module 220 includes a pressure transducer that monitors the pressure in heel tube 217. If the pressure exceeds a predetermined value, the pressure in heel tube 217 is reduced to avoid decubitus ulcers (bedsores) on the patient's heels.

As shown in FIG. 34, alternative foot section 410 includes an expandable foam layer 164 positioned under a plurality of alternating tubes 416, 418. Expandable foam layer 164 includes a plurality of foam strips or segments 222 and a sheath 224 covering strips 222. Sheath 224 is formed to include a plurality of sleeves 226 and webs 228 extending between sleeves 226. Strips 222 are positioned in respective sleeves 226. A head end of sheath 224 is coupled to a stationary portion of cover 116 and a foot end of sheet 224 is coupled to a foot end of cover 116 that retracts when foot section 46 of deck 26 is retracted. As foot section 46 of deck 26 retracts, foam strips 222 bunch together. As foot section 46 of deck 26 extends, a foot end of sheath 224 is pulled with foot section 46 so that adjacent foam strips 222 are also pulled along as respective webs 228 become taunt until foam strips 222 are substantially uniformly spaced apart.

Air tubes 416, 418 are configured to collapse to a near zero dimension when air is withdrawn from tubes 416, 418.

The orientation of tubes 416, 418 in foot portion 410 causes foot portion 410 to retract or shorten and to collapse or thin as tubes 416 are deflated by a foot section control module as the hospital bed 10 moves from the bed position to the chair position. In the chair position, the foot section of the deck and foot portion 410 of the mattress move from a generally horizontal position to a generally vertical, downwardly extending position. Preferably, foot section 410 moves from an extended position to a retracted position to shorten the foot section as the articulating deck of the 10 moves to the chair configuration. Additional description of the foot section of the articulating deck and the tubes of the foot portion of the mattress is provided in U.S. Pat. No. 5,715,548.

A preferred embodiment control module configuration is shown in FIGS. 27 and 28. Bed 10 includes a module housing 278 in which each control module 113, 177, 188, 190, 220 is positioned. A portion of peer-to-peer network 276 is positioned in module housing 278 along with a master/slave communication network 280, a power line 282, and a plurality of respective connectors 284. Module housing 278 includes a pair of spare slots 279 for receiving additional modules.

As shown in FIG. 27, foot section control module 220 includes a master processor 286 connected to peer-to-peer network 276 by a network interface 288 and a connector 290. Foot section control module 220 further includes a RAM circuit 292 and a pair of ROM circuits 294 coupled to master processor 286. RAM and ROM circuits 292, 294 and master processor 286 cooperate to coordinate communications from peer-to-peer network 276 to each respective slave module 113, 177, 188, 190 through master/slave communication network 280. Connector 290 is coupled to peer-to-peer network 276 and a blower 298 to receive communication from other modules (not shown) coupled to peer-to-peer network 276 and to control blower 298.

Each control module 113, 177, 188, 190, 220 includes a slave processor 310, a ROM circuit 312 coupled to the respective slave processors 310, an analog-to-digital converter 314 coupled to the respective slave processors 310, and pressure transducers 316 coupled to the respective analog-to-digital convertors 314. Slave processor 310 of foot section control module 220 is directly coupled to master processor 286 to communicate therewith and slave processors 310 of slave modules 113, 177, 188, 190 are coupled to connectors 318 to communicate with master processor 286 through master/slave communication network 280.

Master processor 286 is a centralized hub between peer-to-peer network 276 and slave modules 113, 177, 188, 190. Master processor 286 receives information/commands from peer-to-peer network 276 and distributes the appropriate information/commands to the respective slave processor 310 of each slave module 113, 177, 188, 190, through master/slave communication network 280. Similarly, master processor 286 receives information/commands from the respective slave processors 310 of each slave module 113, 177, 188, 190. Slave processor 310 of foot section control module 220 sends and receives information/commands directly to and from master processor 286.

As shown in FIG. 27, foot section control module 220 further includes a plurality of vacuum valves 320, 322, 324 and pressure valves 326, 328, 330 coupled to respective heel, collapse, and retract bladders tubes 217, 216, 218 of foot bladder 170. Vacuum valves 320, 322, 324 are also coupled to a vacuum inlet 332 of blower 298 and pressure valves 326, 328, 330 are also coupled to a pressure outlet 334 of blower 298. Foot section control module 220 further includes a plurality of stepper motor drivers 336 electrically coupled to slave processor 310 of foot section control module 220 and coupled to valves 320, 322, 324, 326, 328, 330 that receive commands from slave processor 310 and move valves 320, 322, 324, 326, 328, 330 between the opened and closed positions.

Pressure transducer 316 monitors the air pressure in heel tube 217 so that the air pressure in heel tube 217 does not exceed a predetermined level. If pressure transducer 316 senses a pressure over the predetermined level, slave processor 310 of foot section control module 220 commands stepper motor drivers 336 to open vacuum valve 320 so that the pressure is lowered below the predetermined level. If pressure transducer 316 senses a pressure level below a predetermined level, slave processor 310 of foot section control module 220 commands stepper motor drivers 336 to open pressure valve 326 so that the pressure is raised above the predetermined level.

When slave processor 310 of foot section control module 220 receives a command to retract foot bladder 170 from peer-to-peer network 276 through master processor 286, slave processor 310 commands stepper drivers 336 to move vacuum valve 322 to the opened position so that air is drawn from first set of tubes 216 into vacuum inlet 332 of blower 332 so that air tubes 216 deflate to retract foot bladder 170. When slave processor 310 of foot section control module 220 receives a command to extend foot bladder 170, slave processor 310 commands stepper drivers 336 to close vacuum valve 322 and move pressure valve 328 to the opened position so that air enters first set of tubes 216 from pressure outlet 334 of blower 298 so that air tubes 216 inflate to extend foot bladder 170. Pressure transducer 316 monitors the pressure levels in first set of tubes 216 during retraction, expansion, and normal operation to determine when first set of tubes 216 are with predetermined pressure ranges.

When slave processor 310 of foot section control module 220 receives a command to collapse foot bladder 170, slave processor 310 commands stepper drivers 336 to move vacuum valves 322, 324 to the opened position so that air is drawn from first and second sets of tubes 216, 218 into vacuum inlet 332 of blower 332 so that air tubes 216, 218 deflate to collapse a portion of foot bladder 170. When slave processor 310 of foot section control module 220 receives a command to expand foot bladder 170, slave processor 310 commands stepper drivers 336 to close vacuum valves 322, 324 and move pressure valves 328, 330 to the opened position so that air enters first and second sets of tubes 216, 218 from pressure outlet 334 of blower 298 so that air tubes 216, 218 inflate to expand foot bladder 170. Pressure transducer 316 monitors the pressure levels in first and second sets of tubes 216, 218 during collapsing, expansion, and normal operation to determine when first and second sets of tubes 216, 218 are with predetermined pressure ranges.

As shown in FIG. 27, pulmonary pulsation control module 177 includes a pulsation valve 338 coupled to pulsation bladder 155 and a solenoid valve driver 340 coupled to pulsation valve 338 and slave processor 310. Pulsation valve 338 is also coupled to pressure outlet 334 of blower 298 and open to atmosphere 342. Solenoid valve driver 340 receives commands from slave processor 310 and moves valve 338 to provide oscillations of air to pulsation bladder 155 to quickly move pulsation bladder 155 between inflated and slightly deflated positions. Additional description a suitable pulsation valve and a further description of pulsation therapy are provided in U.S. patent application Ser. No. 09/210,120 entitled Percussion and Vibration Therapy Device to Osborne et al., filed Dec. 11, 1998, the disclosure of which is expressly incorporated by reference herein.

When slave processor 310 of pulmonary pulsation control module 177 receives a command to begin pulmonary pulsation therapy from peer-to-peer network 276 through master processor 286, slave processor 310 commands solenoid valve driver 340 to begin operation of pulsation valve 338 so that oscillations of pressurized air are sent to pulsation bladder 155. When slave processor 310 of pulmonary pulsation control module 177 receives a command to stop pulmonary pulsation therapy, slave processor 310 commands solenoid valve driver 340 to discontinue operation of pulsation valve 338. Pressure transducer 316 of pulmonary pulsation control module 177 monitors the pressure levels in pulsation bladder 155 during pulsation therapy to determine when the pressure level of pulsation bladder 155 is within an acceptable predetermined pressure range.

As shown in FIG. 28, normal operation control module 190 includes a plurality of vacuum valves 344, 346, 348 and pressure valves 350, 352, 354 coupled to respective right and left working bladders 145, 147 and head bladder 132. Vacuum valves 344, 346, 348 are also coupled to a vacuum inlet 332 of blower 298 and pressure valves 350, 352, 354 are also coupled to a pressure outlet 334 of blower 298. Normal operation control module 190 further includes a plurality of stepper motor drivers 336 electrically coupled to slave processor 310 of normal operation control module 190 and coupled to valves 344, 346, 348, 350, 352, 354 that receive commands from slave processor 310 and move valves 344, 346, 348, 350, 352, 354 between opened and closed positions.

During normal operation, pressure transducer 316 monitors the pressure level in head bladder 132. When the pressure in head bladder 132 drops below a predetermined level, pressure valve 350 is moved to the opened position until the pressure increases above a predetermined level. When the pressure in head bladder 132 rises above a predetermined level, vacuum valve 344 opens until the pressure decreases below a predetermined level. As previously mentioned, during rotational therapy, head bladder 132 is slightly deflated by vacuum valve 344 to "cradle" the patient's head as shown in FIG. 16. Similarly, during normal operation, pressure transducer 316 monitors the pressure level in right and left working bladders 145, 147. When the pressures in right and left working bladders 145, 147 drop below a predetermined level, respective pressure valves 352, 354 are moved to the opened position until the pressures increase above a predetermined level. When the pressures in respective right and left working bladders 145, 147 rise above a predetermined level, respective vacuum valve 346, 348 open until the pressures increase below a predetermined level.

As shown in FIG. 27, pulmonary rotational therapy control module 188 further includes a plurality of vacuum valves 356, 358 and pressure valves 360, 362 coupled to respective right and left boost bladders 151, 153 and right and left boost bladders 166, 168 through right and left boost bladders 151, 153. Vacuum valves 356, 358 are also coupled to a vacuum inlet 332 of blower 298 and pressure valves 360, 362 are also coupled to a pressure outlet 334 of blower 298. Pulmonary rotational control module 188 further includes a plurality of stepper motor drivers 364 electrically coupled to slave processor 310 of pulmonary rotational control module 188 and coupled to valves 356, 358, 360, 362. Motor drivers 364 receive commands from slave processor 310 and move valves 356, 358, 360, 362 between opened and closed positions.

When slave processor 310 of pulmonary rotational control module 188 receives a command to begin pulmonary rotational therapy from peer-to-peer network 276 through master processor 286, slave processor 310 commands stepper motor drivers 364 to move vacuum valve 356 to the opened position, vacuum valve 358 to the closed position, pressure valve 360 to the closed position, and pressure valve 362 to the opened position so that air is drawn from left boost bladders 153, 168 and air is introduced to right boost bladders 151, 166 as shown in FIGS. 18, 21, and 24. Simultaneously, slave processor 310 of pulmonary rotational control module 188 instructs slave processor 310 of normal operation control module 190 to inflate and deflate respective working bladders 145, 147.

The communication from slave processor 310 of pulmonary rotational control module 188 to slave processor 310 of normal operation control module 190 occurs through master processor 286 and master/slave communication network 280. During inflation of right boost bladders 151, 166, right working bladder 145 is inflated when stepper motor drivers 336 move pressure valve 352 to the opened position as shown in FIGS. 18, 21, and 24 during the first phase of rotational therapy. During deflation of left boost bladders 153, 168, left working bladder 147 is deflated when stepper motor drivers 336 move vacuum valve 348 to the opened position. Pressure transducer 316 monitors the pressure levels in working and boost bladders 145, 147, 151, 153, 166, 168 during each phase of rotational therapy to determine when the bladders are within predetermined pressure ranges.

To begin the second phase of pulmonary rotational therapy, slave processor 310 commands stepper drivers 364 to move vacuum valve 358 to the opened position, vacuum valve 356 to the closed position, pressure valve 362 to the closed position, and pressure valve 360 to the opened position so that air is drawn from right boost bladders 151, 166 and air is introduced to left boost bladders 153, 168 as shown in FIGS. 19, 22, and 25. Simultaneously, slave processor 310 of pulmonary rotational control module 188 instructs slave processor 310 of normal operation control module 190 to inflate and deflate respective working bladders 145, 147.

During inflation of left boost bladders 153, 168, left working bladder 145 is inflated when stepper motor drivers 336 move pressure valve 354 to the opened position as shown in FIGS. 19, 22, and 25 during the second phase of rotational therapy. During deflation of right boost bladders 151, 166, right working bladder 145 is deflated when stepper motor drivers 336 move vacuum valve 346 to the opened position.

When slave processor 310 of pulmonary rotational control module 188 receives a command to end pulmonary rotational therapy, slave processor 310 commands stepper drivers 364 to move vacuum valves 356, 358 to the opened position so that air is drawn from right and left boost bladders 151, 153, 166, 168 as shown in FIGS. 17, 20, and 23. Simultaneously, slave processor 310 of pulmonary rotational control module 188 instructs slave processor 310 of normal operation control module 190 to move pressure valves 350, 352, 354 to the opened position to inflate right and left working bladders 145, 147 and head bladder 132.

As shown in FIG. 28, treatment therapy control module 113 further includes a plurality of vacuum valves 366, 368, 370 and pressure valves 372, 374, 376 coupled to respective first, second, and third treatment zones 154, 165, 175. Vacuum valves 366, 368, 370 are also coupled to a vacuum inlet 332 of blower 298 and pressure valves 372, 374, 376 are also coupled to a pressure outlet 334 of blower 298. Treatment therapy control module 113 further includes a plurality of stepper motor drivers 378 electrically coupled to slave processor 310 of treatment therapy control module 113 and coupled to valves 366, 368, 370, 372, 374, 376 that receive commands from slave processor 310 and move valves 366, 368, 370, 372, 374, 376 between opened and closed positions.

During a first phase of treatment therapy, first treatment zone 154 is deflated and the other treatment zones 165, 175 remain inflated. To begin the first phase of treatment therapy, slave processor 310 of treatment therapy control module 113 sends commands to stepper motor drivers 378 to move vacuum valve 370 to the opened position and pressure valve 376 to the closed position so that air is drawn from first treatment zone 154 of treatment bladder 149. To end the first phase of treatment therapy, slave processor 310 of treatment therapy control module 113 commands stepper motor drivers 378 to move vacuum valve 370 to the closed position and pressure valve 376 to the opened position so that first treatment zone 154 of treatment bladder 149 moves to the inflated position.

During a second phase of treatment therapy, second treatment bladder 165 is deflated and the other treatment zones 154, 175 remain inflated. To begin the second phase of treatment therapy, slave processor 310 of treatment therapy control module 113 sends commands to stepper motor drivers 378 to move vacuum valve 368 to the opened position and pressure valve 374 to the closed position so that air is drawn from second treatment zone 165. To end the second phase of treatment therapy, slave processor 310 of treatment therapy control module 113 commands stepper motor drivers 378 to move vacuum valve 368 to the closed position and pressure valve 374 to the opened position so that second treatment zone 165 moves to the inflated position.

During a third phase of treatment therapy, third treatment zone 175 is deflated and the other treatment zones 154, 165 remain inflated. To begin the third phase of treatment therapy, slave processor 310 of treatment therapy control module 113 sends commands to stepper motor drivers 378 to move vacuum valve 366 to the opened position and pressure valve 372 to the closed position so that air is drawn from third treatment zone 175. To end the third phase of treatment therapy, slave processor 310 of treatment therapy control module 113 commands stepper motor drivers 378 to move vacuum valve 366 to the closed position and pressure valve 372 to the opened position so that third treatment zone 175 moves to the inflated position.

According to the presently preferred embodiment, the first, second, and third phases of treatment therapy are sequential. According to alternative embodiments, other patterns of inflation and deflation of the treatment bladders are followed. According to other alternative embodiments, the head and foot bladders are also inflated and deflated as part of treatment therapy.

Bed 10 is configured to disable any therapy when bed 10 is in the chair position. Bed 10 includes a sensor 230, as shown in FIGS. 2 and 29, configured to detect when foot section 46 of deck 26 is in the lowered position. According to the presently preferred embodiment of the disclosure, the sensor includes a potentiometer positioned to detect changes in the angular position of the foot section of the deck relative to the thigh section of the deck. According to alternative embodiments of the present invention, other angle detection devices and other position sensors are used.

Sensor 230 is coupled to communicate with the respective control modules of the inflatable therapy apparatus 110, 112, 114. When sensor 230 detects that foot section 46 of deck 26 drops below a predetermined displacement angle, sensor 230 instructs the respective control modules to terminate therapy.

Bed 10 is also configured to disable any therapy when any of siderails 28, 30 are lowered from the raised position. Bed 10 includes four sets of siderail sensors or position detectors 232, as shown in FIG. 30, configured to detect when the respective siderails 28, 30 are lowered from the up position. Each siderail includes a flange 234 coupled to bedframe 22 (not shown in FIG. 30) and a link 236 pivotably coupled to flange 234. Link 236 pivots on flange 234 as siderails 28, 30 move from the up position to the down position (phantom). Additional description of the siderail is disclosed in U.S. Pat. No. 5,715,548.

Each siderail sensor 232 includes a proximity clip 238 coupled to a proximal end of link 236, as shown in FIG. 30, and a switch 240 fastened to side portion 72 of upper deck 66. Clip 238 includes a body portion 242 that houses a magnet 244, a C-shaped portion 246 coupled to body portion 242 and defining a channel 243 sized to receive link 236, and a flange 248 including a pair of downwardly tabs 250, as shown in FIGS. 30 and 31. To install clip 238 on link 236 of respective siderail 28, 30, C-shaped portion 246 of clips 238 is pried back and slipped over the proximal end of link 236 so that tabs 250 straddle link 236, as shown in FIG. 31. Switch 240 is preferably a reed switch. According to alternative embodiments of the present invention, other configurations of switches or proximity sensors maybe used.

As link 236 of respective siderail 28, 30 rotates from the up position to the down position, magnet 244 moves relative to switch 240 from a first position (shown in solid lines in FIG. 30) relative to switch 240 to a second position (shown in phantom lines in FIG. 30) further away from switch 240.

Switch 240 is configured to detect the change in position of magnet 244 so that as magnet 244 moves toward the second position, switch 240 detects the change in position of respective siderails 28, 30.

Switch 240 is in communication with the respective control modules of the inflatable therapy apparatus 110, 112, 114. When switch 240 detects that any of siderails 28, 30 drop below a predetermined level, switch 240 instructs the respective control modules to terminate therapy.

An alternative embodiment siderail sensor 252 is shown in FIGS. 32 and 33. Each sensor 252 includes a proximity clip 258 coupled to a proximal end of a siderail component 256, as shown in FIG. 33 and a switch clip 260 fastened over side portion 72 of upper deck 66. Proximity clip 258 includes a C-shaped portion 262 and a body portion 264 including a magnet 266 therein. Proximity clip 258 is slipped over a proximal end of siderail component 256 to pinch siderail component 256 as shown in FIG. 33. Switch clip 260 includes a U-shaped clip portion 268 and a switch body 272 coupled thereto. Clip portion 268 is slid over side portion 72 of upper deck 66 and fastened thereto with fasteners 270. Switch body 272 includes a switch 274 positioned therein. According to the present disclosure, switch 274 is preferably a reed switch. According to alternative embodiments of the present invention, other configurations of switches or proximity sensors maybe used.

As siderail component 256 moves during rotation of the respective siderail from the up position to the down position, magnet 266 moves relative to switch 274 from a first position relative to switch 274 to a second position further away from switch 274. Switch 274 is configured to detect the change in position of magnet 266 so that as magnet 266 moves toward the second position, switch 274 detects the change in position of the respective siderail.

Switch 274 is in communication with the respective control modules of the inflatable therapy apparatus. When switch 274 detects that any of the siderails drop below a predetermined level, switch 274 instructs the respective control modules to terminate therapy.

Although the invention has been described in detail with reference to preferred embodiments, variations and modifications exist within the scope and spirit of the invention as described and defined in the following claims.

What is claimed is:

1. A chair bed comprising a bedframe including a deck having a foot section, the foot section being movable between a substantially horizontal position when the bed is in a bed position and a substantially vertical position when the bed is in a chair position, and a mattress positioned on the bedframe, the mattress including a support surface and an inflatable treatment apparatus configured to move between inflated and deflated positions to provide treatment to a patient positioned on the support surface, the inflatable treatment apparatus being a rotational therapy device configured to position a left portion of the support surface higher than a right portion of the support surface for a period of time and then position the left portion of the support surface lower than the right portion of the support surface for a period of time.

2. The chair bed of claim 1, wherein the rotational therapy device includes a first bladder and a second bladder, the first bladder is positioned on a left portion of the mattress and the second bladder is positioned on a right portion of the mattress, the first bladder is configured to oscillate between an inflated position and a deflated position, the second bladder is configured to oscillate between an inflated position when the first bladder is in the deflated position and a deflated position when the first bladder is in the inflated position.

3. The chair bed of claim 2, wherein the first and second bladders are positioned over the foot section of the deck.

4. The chair bed of claim 3, wherein the rotational therapy device further includes third and fourth bladders, the third bladder is positioned on the left portion of the mattress, the fourth bladder is positioned on the right portion of the mattress, the third bladder is configured to oscillate between an inflated position and a deflated position, and the fourth bladder is configured to oscillate between an inflated position when the third bladder is in the deflated position and a deflated position when the third bladder is in the inflated position.

5. The chair bed of claim 3, wherein the deck further includes head, thigh and seat sections and the third and fourth bladders are positioned over at least one of the head, thigh and seat sections.

6. The chair bed of claim 2, wherein the rotational therapy device further includes third and fourth bladders, the third bladder is positioned on a left portion of the mattress, the fourth bladder is positioned on a right portion of the mattress, the third bladder is configured to oscillate between an inflated position and a deflated position, and the fourth bladder is configured to oscillate between an inflated position when the third bladder is in the deflated position and a deflated position when the third bladder is in the inflated position.

7. The chair bed of claim 6, wherein the third bladder is positioned under the first bladder and the fourth bladder is positioned under the second bladder.

8. The chair bed of claim 7, wherein the first and second bladders are normally inflated and the third and fourth bladders are normally deflated.

9. The chair bed of claim 6, wherein the third bladder is positioned longitudinally of the first bladder and the fourth bladder is positioned longitudinally of the second bladder.

10. The chair bed of claim 9, wherein the third and fourth bladders are positioned over the foot section of the deck.

11. The chair bed of claim 8, wherein the mattress further includes a resilient component positioned between the first and third bladders and the second and fourth bladders.

12. The chair bed of claim 9, wherein the deck further includes head, thigh and seat sections and the third and fourth bladders are positioned over at least one of the head, thigh and seat sections.

13. The chair bed of claim 1, further comprising a sensor positioned to detect a change in position of the foot section of the deck, wherein the positioning of the right and left portions of the support surface is disabled if the sensor detects the foot section of the deck has moved from the substantially horizontal position.

14. The chair bed of claim 13, wherein the sensor is configured to detect the angular displacement of the foot section of the deck from the substantially horizontal position and disables the positioning of the right and left portions of the support surface upon angular displacement of the foot section beyond a predetermined displacement angle.

15. A chair bed comprising a bedframe including a deck having a foot section, the foot section being movable between a substantially horizontal position when the bed is in a bed position and a substantially vertical position when the bed is in a chair position, and a mattress positioned on the bedframe, the mattress including a support surface and an inflatable treatment apparatus configured to move between inflated and deflated positions to provide treatment to a patient positioned on the support surface, the mattress including a foot portion positioned over the foot section of the deck and segmented from the remainder of the mattress to permit movement of the foot portion of the mattress with the foot section of the deck during movement of the foot section of the deck between the bed and chair positions, the inflatable treatment apparatus including a pulsation therapy bladder configured to pulsate at a predetermined rate.

16. A chair bed comprising a bedframe including a deck having a foot section, the foot section being movable between a substantially horizontal position when the bed is in a bed position and a substantially vertical position when the bed is in a chair position, and a mattress positioned on the bedframe, the mattress including a support surface and an inflatable treatment apparatus configured to move between inflated and deflated positions to provide treatment to a patient positioned on the support surface, the inflatable treatment apparatus including a pulsation therapy bladder configured to pulsate at a predetermined rate, the mattress further including a layer of resilient material positioned beneath the pulsation therapy bladder.

17. The chair bed of claim 16, wherein the inflatable treatment apparatus further includes a rotational therapy device positioned beneath the layer of resilient material.

18. A chair bed comprising a bedframe including a deck having a foot section, the foot section being movable between a substantially horizontal position when the bed is in a bed position and a substantially vertical position when the bed is in a chair position, the foot section is configured to move between a retracted position having a first length and an extended position having a second length that is greater than the first length, and a mattress positioned on the bedframe, the mattress including a support surface and an inflatable treatment apparatus configured to move between inflated and deflated positions to provide treatment to a patient positioned on the support surface, the mattress including a foot portion positioned over the foot section of the deck and segmented from the remainder of the mattress to permit movement of the foot portion of the mattress with the foot section of the deck during movement of the foot section of the deck between the bed and chair positions, the inflatable treatment apparatus being a rotational therapy device including first and second bladders positioned over the foot section of the deck, the first bladder being positioned on a left portion of the mattress, and the second bladder being positioned on a right portion of the mattress, the first bladder being configured to oscillate between an inflated position and a deflated position, the second bladder being configured to oscillate between an inflated position when the first bladder is in the deflated position and a deflated position when the first bladder is in the inflated position.

19. A chair bed comprising a bedframe including a deck having a foot section, the foot section being movable between a substantially horizontal position when the bed is in a bed position and a substantially vertical position when the bed is in a chair position, and a mattress positioned on the bedframe, the mattress including a support surface and an inflatable treatment apparatus configured to move between inflated and deflated positions to provide treatment to a patient positioned on the support surface, the mattress including a foot portion positioned over the foot section of the deck and segmented from the remainder of the mattress to permit movement of the foot portion of the mattress with the foot section of the deck during movement of the foot section of the deck between the bed and chair positions, the inflatable treatment apparatus including a first treatment bladder, a second treatment bladder positioned longitudinally of the first treatment bladder, and a third treatment bladder positioned longitudinally of the second treatment bladder and each of the first, second, and third treatment bladders being configured to oscillate between inflated and deflated positions.

20. The chair bed of claim 19, wherein the deck further includes thigh, seat, and head sections, the first treatment bladder is positioned over the head section of the deck, the second treatment bladder is positioned over the seat section of the deck, and the third treatment bladder is positioned over the thigh section of the deck.

21. The chair bed of claim 19, wherein the first, second, and third treatment bladders each include a plurality of aligned tubes.

22. The chair bed of claim 19, wherein the oscillation of the first, second, and third treatment bladders between the inflated and deflated positions is coordinated to create an undulating support surface.

23. The chair bed of claim 22, wherein the deck further includes thigh, seat, and head sections, the first treatment bladder is positioned over the head section of the deck, the second treatment bladder is positioned over the seat section of the deck, and the third treatment bladder is positioned over the thigh section of the deck.

24. The chair bed of claim 22, wherein the oscillation of the second treatment bladder follows the oscillation of the first treatment bladder and the oscillation of the third treatment bladder follows the oscillation of the second treatment bladder so that the undulating surface follows a wave pattern.

25. A chair bed comprising a bedframe including a deck having a foot section, the foot section being movable between a substantially horizontal position when the bed is in a bed position and a substantially vertical position when the bed is in a chair position, a mattress positioned on the bedframe, the mattress including a support surface and an inflatable treatment apparatus configured to move between inflated and deflated positions to provide treatment to a patient positioned on the support surface, and a sensor positioned to detect a change in position of the foot section of the deck, the inflatable treatment apparatus movement between inflated and deflated positions being disabled if the sensor detects the foot section of the deck has moved from the substantially horizontal position.

26. The chair bed of claim 25, wherein the sensor is configured to detect the angular displacement of the foot section of the deck from the substantially horizontal position and the oscillation of the inflatable treatment apparatus is disabled upon detection of the angular displacement of the foot section beyond a predetermined displacement angle.

27. The chair bed of claim 25, wherein the inflatable treatment apparatus is a pulsation therapy device configured to pulsate at a predetermined rate.

28. The chair bed of claim 25, wherein the inflatable apparatus includes at least two oscillating treatment bladders.

29. A bed comprising a bedframe including a deck having a foot section, the foot section being movable between a retracted position having a first length and an extended position having a second length that is greater than the first length and a mattress positioned on the bedframe, the mattress including a support surface and an inflatable treatment apparatus configured to move between inflated and deflated positions to provide treatment to a patient positioned on the support surface, the inflatable apparatus being a rotational therapy device configured to position a left portion of the support surface higher than a right portion of the support surface for a period of time and then position the left portion of the support surface lower than the right portion of the support surface for a period of time.

30. The bed of claim 29, wherein the rotational therapy device includes a first bladder and a second bladder, the first bladder is positioned on a left portion of the mattress, the second bladder is positioned on a right portion of the mattress, the first bladder is configured to oscillate between an inflated position and a deflated position, the second bladder is configured to oscillate between an inflated position when the first bladder is in the deflated position and a deflated position when the first bladder is in the inflated position.

31. The bed of claim 30, wherein the first and second bladders are positioned over the foot section of the deck.

32. The bed of claim 31, wherein the rotational therapy device further includes third and fourth bladders, the third bladder is positioned on the left portion of the mattress, the fourth bladder is positioned on the right portion of the mattress, the third bladder is configured to oscillate between an inflated position and a deflated position, and the fourth bladder is configured to oscillate between an inflated position when the third bladder is in the deflated position and a deflated position when the third bladder is in the inflated position.

33. The bed of claim 32, wherein the deck further includes thigh and seat sections, and the third and fourth bladders are positioned over at least one of the thigh and seat sections of the bedframe.

34. The bed of claim 33, wherein the rotational therapy device further includes third and fourth bladders, the third bladder is positioned on the left portion of the mattress, the fourth bladder is positioned on the right portion of the mattress, the third bladder is configured to oscillate between an inflated position and a deflated position, and the fourth bladder is configured to oscillate between an inflated position when the third bladder is in the deflated position and a deflated position when the third bladder is in the inflated position.

35. The bed of claim 34, wherein the third bladder is positioned under the first bladder and the fourth bladder is positioned under the second bladder.

36. The bed of claim 35, wherein the first and second bladders are normally inflated and the third and fourth bladder are normally deflated.

37. The bed of claim 36, wherein the third bladder is positioned longitudinally of the first bladder and the fourth bladder is positioned longitudinally of the second bladder.

38. The bed of claim 37, wherein the third and fourth bladders are positioned over the foot section of the deck.

39. The bed of claim 38, wherein the mattress further includes a resilient component positioned between the first and third bladders and the second and fourth bladders.

40. The bed of claim 39, wherein the deck further includes a thigh section, and the third and fourth bladders are positioned over the thigh section of the bedframe.

41. The bed of claim 40, wherein the rotational therapy device further includes companion bladders positioned under each of the first, second, third, and fourth bladders, each companion bladder being configured to oscillate between inflated and deflated positions as the respective first, second, third, and fourth bladders oscillate between the inflated and deflated positions.

42. A bed comprising a bedframe including a deck having a foot section, the foot section being movable between a retracted position having a first length and an extended position having a second length that is greater than the first length and a mattress positioned on the bedframe, the mattress including a support surface and an inflatable treatment apparatus configured to move between inflated and deflated positions to provide treatment to a patient positioned on the support surface, the inflatable treatment apparatus being a pulsation therapy device configured to pulsate at a predetermined rate, the mattress further including a layer of resilient material positioned beneath the pulsation therapy device.

43. The bed of claim 42, wherein the inflatable treatment apparatus further includes a rotational therapy device positioned beneath the layer of resilient material.

44. A bed comprising a bedframe including a deck having a foot section, the foot section being movable between a retracted position having a first length and an extended position having a second length that is greater than the first length, and a mattress positioned on the bedframe, the mattress including a support surface and an inflatable treatment apparatus configured to move between inflated and deflated positions to provide treatment to a patient positioned on the support surface, a retractable foot portion of the mattress including at least a portion of the inflatable treatment apparatus, further comprising a first treatment bladder, a second treatment bladder positioned longitudinally of the first treatment bladder, and a third treatment bladder positioned longitudinally of the second treatment bladder and each of the first, second, and third treatment bladders being configured to oscillate between inflated and deflated positions.

45. The bed of claim 44, wherein the deck further includes a thigh section, a seat section, and a head section, the first treatment bladder is positioned over the head section of the deck, the second treatment bladder is positioned over the seat section of the deck, and the third treatment bladder is positioned over the thigh section of the deck.

46. The bed of claim 45, wherein the first, second, and third treatment bladders each include a plurality, of aligned tubes.

47. The bed of claim 44, wherein the oscillation of the first, second, and third treatment bladders between the inflated and deflated positions is coordinated to create an undulating support surface.

48. The bed of claim 47, wherein the deck further includes a thigh section, a seat section, and a head section, the first treatment bladder is positioned over the head section of the deck, the second treatment bladder is positioned over the seat section of the deck, and the third treatment bladder is positioned over the thigh section of the deck.

49. The bed of claim 48, wherein the oscillation of the second treatment bladder follows the oscillation of the first treatment bladder and the oscillation of the third treatment bladder follows the oscillation of the second treatment bladder so that the undulating support surface follows a wave pattern.

50. A bed comprising a bedframe, and a mattress positioned on the bedframe, the mattress including a support, surface, a pulsation therapy device configured to pulsate at a predetermined rate, a rotational therapy device configured to position a left portion of the support surface higher than a right portion of the support surface for a period of time and then position the left portion of the support surface lower than the right portion of the support surface for a period of time, and a layer of resilient material positioned between the pulsation therapy device and the rotational therapy device.

51. The bed of claim 50, wherein the bedframe includes a deck having foot, thigh, seat, and head sections, the pulsation therapy device is positioned over the head section.

52. The bed of claim 50, wherein the bedframe includes a deck having thigh, seat, and head sections, and the mattress further includes an inflatable bladder positioned over at least one of the thigh, seat, and head sections of the deck and under the lag, of resilient material.

53. The bed of claim 52, wherein the inflatable bladder is positioned between the rotational therapy device and the layer of resilient material.

54. The bed of claim 50, wherein the bedframe includes a deck having foot, thigh, seat, and head sections, and the mattress further includes an inflatable bladder positioned over the head section of the deck and a layer of resilient material positioned under the inflatable bladder.

55. The bed of claim 54, wherein the foot section of the deck is configured to move between a retracted position having a first length and an extended position having a second length greater than the first length and the layer of resilient material positioned under the inflatable bladder includes a series of resilient segments and a sheath coupling the resilient segments together.

56. The bed of claim 54, wherein the mattress further includes another inflatable bladder positioned over the head section of the deck and another layer of resilient material positioned under the inflatable bladder positioned over the head section of the deck.

57. The bed of claim 54, wherein the bedframe includes a deck having head and torso portions, and the layer of resilient material terminates short of the head portion of the deck.

58. The bed of claim 57, wherein the deck further includes a foot section and the layer of resilient material terminates short of the foot section.

59. The bed of claim 50, wherein the bedframe includes a deck having foot, thigh, seat, and head sections, and the layer of resilient material terminates short of the foot section of the deck.

60. The bed of claim 59, wherein the bedframe further includes a deck having head, seat, thigh, and foot sections, the deck has a stepped configuration defining a recess, the mattress further includes a panel positioned to substantially fill the recess defined by the deck.

61. The bed of claim 60, wherein the mattress further includes a cover surrounding the pulsation therapy device, layer of resilient material, rotational therapy device, and panel.

62. A bed comprising a bedframe and a mattress including a lower surface positioned on the bedframe, an upper surface facing away from the lower surface, and a rotational therapy device, the upper surface having a left portion and a right portion, the rotational therapy device being configured to maintain the right and left portions of the upper surface at a normal height during normal operation of the mattress, the rotational therapy device being configured to provide a rotational therapy operation oscillating the mattress between first and second phases, the left portion of the upper surface being below the normal height and the right portion being above the normal height during the first phase, the right portion of the upper surface being below the normal height and the left portion being above the normal height during the second phase.

63. The bed of claim 62, wherein the rotational therapy device includes a first working bladder, a first boost bladder, a second working bladder, and a second boost bladder, the first and second working bladders are inflated during normal operation of the mattress, and the first and second boost bladder are deflated during normal operation of the mattress.

64. The bed of claim 63, wherein the first working bladder and the first boost bladder are inflated during the first phase of rotational therapy operation and the second working bladder and the second boost bladder are deflated during the first phase of rotational therapy operation.

65. The bed of claim 64, wherein the first working bladder and the first boost bladder are deflated during the second phase of rotational therapy operation and the second working bladder and the second boost bladder are inflated during the second phase of rotational therapy operation.

66. The bed of claim 65, wherein the rotational therapy device further includes third and fourth boost bladders, the third boost bladder being inflated during the first phase of the rotational therapy operation and deflated during the second phase of the rotational therapy operation, and the fourth boost bladder being deflated during the first phase of the rotational therapy operation and inflated during the second phase of the rotational therapy operation.

67. The bed of claim 63, wherein the mattress further comprises a layer of resilient material positioned above the first and second working bladders.

68. The bed of claim 67, wherein the mattress further comprises a layer of resilient material positioned under the first and second working bladders.

69. The bed of claim 67, wherein the first boost bladder is positioned under the first working bladder and the second boost bladder is positioned under the second working bladder.

70. The bed of claim 62, wherein the rotational therapy device further includes third and fourth boost bladders, the third boost bladder being inflated during the first phase of the rotational therapy operation and deflated during the second phase of the rotational therapy operation, and the fourth boost bladder being deflated during the first phase of the rotational therapy operation and inflated during the second phase of the rotational therapy operation.

71. The bed of claim 62, wherein the rotational therapy device includes a rotational control module, the rotational control module is movable between an attached position coupled to the bedframe and a detached position spaced apart from the bedframe, the rotational control module is configured to enable the rotational therapy operation while in the attached position and disable the rotational therapy operation while in the detached position.

72. The bed of claim 71, further comprising a normal operation control module coupled to the bedframe, wherein the normal operation control module is configured to control the rotational therapy device to maintain the right and left portions of the mattress at the normal height during normal operation.

73. The bed of claim 72, wherein the rotational therapy device includes a first working bladder, a first boost bladder, a second working bladder, and a second boost bladder, the first and second working bladders are inflated during normal operation by control of the normal operation control module, and the first and second boost bladder are deflated during normal operation.

74. The bed of claim 73, wherein the first working bladder and the first boost bladder are inflated during the first phase of the rotational therapy operation, the second working bladder and the second boost bladder are deflated during the first phase of the rotational therapy operation, and the rotational control module is configured to control the inflation and deflation of the first and second boost bladders and the normal control module controls first and second working bladders during the first and second phases of the rotational therapy operation.

75. A bed comprising a bedframe, a mattress configured to support a patient, the mattress including a bottom surface resting on the bedframe, a top surface facing away from the bottom surface, and a rotational therapy device, the top surface having a right portion and a left portion, the rotational therapy device being configured to provide a normal operation during which the right and left portions of the top surface are maintained at substantially equal heights and a rotational therapy operation oscillating between a first phase and a second phase, the left portion of the top surface being positioned higher than the right portion of the top surface during the first phase, the right portion of the top surface being positioned higher than the left portion of the top surface during the second phase, and a rotational control module movable between an attached position coupled to the bedframe and a detached position spaced apart from the bedframe, the rotational control module controlling the oscillations between the first and second phases of the rotational therapy operation.

76. The bed of claim 75, further comprising a normal operation control module coupled to the bedframe, wherein the normal operation control module controls the normal operation of the mattress when the rotational control module is in the detached position.

77. The bed of claim 76, wherein the rotational therapy device includes a first working bladder and a second working bladder, the first and second working bladders are movable between inflated and deflated positions, and the normal operation control module is configured to control the rotational therapy device to maintain the first and second working bladders in the inflated position when the rotational control module is in the detached position.

78. The bed of claim 77, wherein the rotational therapy device further includes first and second boost bladders movable between inflated and deflated positions, the first boost bladder is in the inflated position during the first phase of the rotational therapy operation and in the deflated position during the second phase, and the second boost bladder is in the deflated position during the first phase of the rotational therapy operation and in the inflated position during the second phase.

79. The bed of claim 76, wherein the first boost bladder is positioned below the first working bladder and the second boost bladder is positioned below the second working bladder.

80. A chair bed comprising a bedframe including a deck having a foot section, the foot section being movable between a substantially horizontal position when the bed is in a bed position and a substantially vertical position when the bed is in a chair position, and a mattress positioned on the bedframe, the mattress including a support surface and an inflatable treatment apparatus configured to move between inflated and deflated positions to provide treatment to a patient positioned on the support surface, the mattress including a foot portion positioned over the foot section of the deck and segmented from the remainder of the mattress to permit movement of the foot portion of the mattress with the foot section of the deck during movement of the foot section of the deck between the bed and chair positions, the inflatable treatment apparatus including a first bladder included in the foot portion of the mattress and a second bladder segmented from the first bladder and included in the remainder of the mattress.

81. The bed of claim 80, wherein the first and second bladders are in fluid communication to be simultaneously inflated and deflated.

82. The bed of claims 80, wherein the first bladder extends longitudinally.

83. A bed comprising a bedframe including a deck having a foot section, the foot section being movable between a retracted position having a first length and an extended position having a second length that is greater than the first length, and a mattress positioned on the bedframe, the mattress including a support surface and an inflatable treatment apparatus configured to move between inflated and deflated positions to provide treatment to a patient positioned on the support surface, a retractable foot portion of the mattress including at least a portion of the inflatable treatment apparatus, the foot portion of the mattress and the remainder of the mattress cooperate to define a gap therebetween that widens as the foot section of the deck is moved from the bed position to the chair position.

84. A bed comprising a bedframe including a deck having a foot section, the foot section being movable between a retracted position having a first length and an extended position having a second length that is greater than the first length, and a mattress positioned on the bedframe, the mattress including a support surface and an inflatable treatment apparatus configured to move between inflated and deflated positions to provide treatment to a patient positioned on the support surface, a retractable foot portion of the mattress including at least a portion of the inflatable treatment apparatus, the portion of the inflatable treatment apparatus being segmented from the remainder of the inflatable treatment apparatus.

85. A bed comprising a bedframe including a deck having a foot section, the foot section being movable between a retracted position having a first length and an extended position having a second length that is greater than the first length, and a mattress positioned on the bedframe, the mattress including a support surface and an inflatable treatment apparatus configured to move between inflated and deflated positions to provide treatment to a patient positioned on the support surface, a retractable foot portion of the mattress including at least a portion of the inflatable treatment apparatus, the portion of the inflatable treatment apparatus having a longitudinal length substantially less than the second length of the foot section of the deck.

86. A bed comprising a bedframe including a deck having a foot section, the foot section being movable between a retracted position having a first length and an extended position having a second length that is greater than the first length, the foot section of the deck having a first end positioned adjacent to the remainder of the deck and a second end longitudinally spaced apart from the first end and the inflatable treatment apparatus being positioned adjacent to the first end of the foot section of the deck and spaced apart from the second end of the foot section of the deck, and a mattress positioned on the bedframe, the mattress including a support surface and an inflatable treatment apparatus configured to move between inflated and deflated positions to provide treatment to a patient positioned on the support surface, a retractable foot portion of the mattress including at least a portion of the inflatable treatment apparatus.

87. A bed comprising a bedframe including a deck having a foot section, the foot section being movable between a retracted position having a first length and an extended position having a second length that is greater than the first length, and a mattress positioned on the bedframe, the mattress including a support surface and an inflatable treatment apparatus configured to move between inflated and deflated positions to provide treatment to a patient positioned on the support surface, a retractable foot portion of the mattress including at least a portion of the inflatable treatment apparatus, the foot portion of the mattress having a first length and the portion of the inflatable treatment apparatus having a second length that is substantially less than the first length of the foot portion.

* * * * *